US009042773B2

(12) United States Patent
Chang et al.

(10) Patent No.: US 9,042,773 B2
(45) Date of Patent: May 26, 2015

(54) ELECTROPHOTOGRAPHIC IMAGE FORMING APPARATUS AND DEVELOPMENT CARTRIDGE

(71) Applicant: SAMSUNG ELECTRONICS CO., LTD., Suwon-si, Gyeonggi-do (KR)

(72) Inventors: Hyung-seok Chang, Seoul (KR); Byeong-no Jeong, Suwon-si (KR); Seong-ho Jeong, Seoul (KR); Ji-won Moon, Suwon-si (KR); Jong-won Han, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/906,582

(22) Filed: May 31, 2013

(65) Prior Publication Data

US 2014/0205314 A1 Jul. 24, 2014

Related U.S. Application Data

(60) Provisional application No. 61/756,269, filed on Jan. 24, 2013, provisional application No. 61/758,957, filed on Jan. 31, 2013, provisional application No. 61/758,970, filed on Jan. 31, 2013.

(30) Foreign Application Priority Data

Apr. 23, 2013 (KR) ..... 10-2013-0045046

(51) Int. Cl.
*G03G 21/16* (2006.01)
*G03G 21/18* (2006.01)

(52) U.S. Cl.
CPC ..... *G03G 21/1853* (2013.01); *G03G 21/1633* (2013.01); *G03G 21/1652* (2013.01); *G03G 21/1821* (2013.01)

(58) Field of Classification Search
CPC ..... G03G 21/16
USPC ..... 399/110
See application file for complete search history.

(56) References Cited

U.S. PATENT DOCUMENTS 5,160,964 A 11/1992 Takahashi et al.
6,654,581 B2 * 11/2003 Liu et al. ..... 399/262

(Continued)

FOREIGN PATENT DOCUMENTS

EP 1806634 A1 7/2007
JP EP1806634 * 10/2005 ..... G03G 21/18

(Continued)

OTHER PUBLICATIONS

European Search Report mailed Sep. 4, 2013 in related European Application No. 13170028.8.
European Office Action mailed Sep. 30, 2013 in related European Application No. 13170028.8.

(Continued)

*Primary Examiner* — Clayton E LaBalle
*Assistant Examiner* — Kevin Butler
(74) *Attorney, Agent, or Firm* — Staas & Halsey LLP

(57) ABSTRACT

An electrophotographic image forming apparatus and a development cartridge are provided. The electrophotographic image forming apparatus includes a body including an opening, a photoreceptor cartridge attached to, or detached from, the body through the opening, a photoconductive drum and a mounting portion, a development cartridge attached to, or detached from, the mounting portion through the opening while the photoreceptor cartridge is mounted in the body, a development roller supplying toner to an electrostatic latent image formed on the photoconductive drum, a cover for opening or closing the opening, and a pressurizing unit fixing the development cartridge to the mounting portion by providing a pressing force to the development cartridge in a direction parallel to a center line connecting centers of the photoconductive drum and development roller while the opening is closed.

9 Claims, 29 Drawing Sheets

(56) References Cited

U.S. PATENT DOCUMENTS

| | | | | |
|---|---|---|---|---|
| 6,678,489 | B1 | 1/2004 | Carter et al. | |
| 6,690,903 | B2 | 2/2004 | Okabe et al. | |
| 6,873,810 | B2 | 3/2005 | Okabe et al. | |
| 7,616,907 | B2 | 11/2009 | Kim et al. | |
| 8,121,518 | B2 * | 2/2012 | Sato | 399/111 |
| 8,457,525 | B2 | 6/2013 | Kamimura | |
| 2003/0049046 | A1 * | 3/2003 | Okabe | 399/111 |
| 2004/0096240 | A1 | 5/2004 | Kim | |
| 2005/0002682 | A1 * | 1/2005 | Lyu et al. | 399/107 |
| 2005/0111881 | A1 | 5/2005 | Arimitsu et al. | |
| 2005/0191090 | A1 | 9/2005 | Nishimura | |
| 2006/0257163 | A1 | 11/2006 | Sato | |
| 2007/0071496 | A1 | 3/2007 | Lee | |
| 2007/0147887 | A1 | 6/2007 | Hattori | |
| 2009/0067877 | A1 | 3/2009 | Terai | |
| 2011/0064461 | A1 | 3/2011 | Ishii et al. | |
| 2011/0091222 | A1 * | 4/2011 | Kim et al. | 399/9 |
| 2011/0206410 | A1 | 8/2011 | Okabe | |
| 2011/0236060 | A1 | 9/2011 | Takagi | |
| 2014/0037330 | A1 | 2/2014 | Hiramatsu et al. | |

FOREIGN PATENT DOCUMENTS

| | | |
|---|---|---|
| JP | 2009-181018 | 8/2009 |
| JP | 2009-244555 | 10/2009 |
| JP | 2010-266893 | 11/2010 |
| JP | 2011-22616 | 2/2011 |
| JP | 2011-65185 | 3/2011 |
| JP | 4743199 | 5/2011 |
| JP | 2012-42725 | 3/2012 |
| KR | 10-2007-0087738 | 8/2007 |
| KR | 10-2011-0071440 | 6/2011 |
| KR | 10-1066103 | 9/2011 |

OTHER PUBLICATIONS

European Search Report mailed Sep. 4, 2013 in related European Application No. 13170061.9.

European Office Action mailed Sep. 30 in related European Application No. 13170061.9.

Office Action mailed Aug. 6, 2014 in related U.S. Appl. No. 14/021,518.

Office Action mailed Dec. 1, 2014 in related U.S. Appl. No. 13/906,587.

Office Action mailed Dec. 5, 2014 in related U.S. Appl. No. 14/021,518.

Office Action mailed Nov. 20, 2014 in related U.S. Appl. No. 14/021,518.

Korean Notice of Allowance mailed Sep. 22, 2014 in related Korean Application No. 10-2013-0045046.

Korean Notice of Allowance mailed Sep. 22, 2014 in related Korean Application No. 10-2013-0045047.

European Office Action mailed Oct. 30, 2014 in related European Application No. 13170061.9.

Extended European Search Report mailed Jun. 12, 2014 in related European Application No. 13196416.5.

European Office Action mailed Apr. 29, 2014 in related European Application No. 1317061.9.

European Office Action mailed Apr. 28, 2014 in related European Application No. 13170028.8.

Office Action mailed Sep. 9, 2014 in related U.S. Appl. No. 14/029,172.

Office Action mailed Dec. 22, 2014 in related U.S. Appl. No. 14/014,626.

Notice of Allowance mailed Feb. 2, 2015 in related U.S. Appl. No. 14/029,172.

European Office Action issued Mar. 10, 2015 in corresponding European Application No. 1317002.8.

* cited by examiner

ELECTROPHOTOGRAPHIC IMAGE FORMING APPARATUS AND DEVELOPMENT CARTRIDGE

CROSS-REFERENCE TO RELATED APPLICATIONS

This application is related to, and claims priority to, U.S. Provisional Application No. 61/756,269, filed on Jan. 24, 2013, U.S. Provisional Application No. 61/758,957, filed on Jan. 31, 2013, and U.S. Provisional Application No. 61/758,970, filed on Jan. 31, 2013, in the U.S. Patent and Trademark office, and Korean Patent Application No. 10-2013-0045046, filed on Apr. 23, 2013, in the Korean Intellectual Property Office, the disclosures of which are incorporated herein by reference.

BACKGROUND

1. Field

Embodiments of the present invention relate to an electrophotographic image forming apparatus capable of detaching a process cartridge, and a development cartridge.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and is a consumable product that is detachable from a body of an image forming apparatus and replaceable after a life is ended. An integrated process cartridge includes a photoreceptor and contains toner to be supplied to the photoreceptor. However, an amount (life) of toner contained in the integrated process cartridge is usually shorter than a life of the photoreceptor. Since a life of the integrated process cartridge may be dependent upon the amount of toner contained therein, after the toner is all used up, the integrated process cartridge has to be replaced even if the life of the photoreceptor is not expired, thereby increasing consumable product costs for a user.

In order to reduce consumable product costs, a separable process cartridge has been designed so that a photoreceptor cartridge including a photoreceptor and a development cartridge containing toner are individually replaced.

SUMMARY

Additional aspects and/or advantages will be set forth in part in the description which follows and, in part, will be apparent from the description, or may be learned by practice of the invention.

It is an aspect of the present invention to provide an electrophotographic image forming apparatus capable of individually detaching a photoreceptor cartridge and a development cartridge from a body, wherein a development roller and a photoconductive drum form a stable development nip (or a development gap), and a development cartridge.

According to an aspect of the present invention, there is provided an electrophotographic image forming apparatus including: a body including an opening; a photoreceptor cartridge attached to or detached from the body through the opening, and including a photoconductive drum and a mounting portion; a development cartridge attached to or detached from the mounting portion through the opening while the photoreceptor cartridge is mounted in the body, and including a development roller supplying toner to an electrostatic latent image formed on the photoconductive drum; and a cover for opening or closing the opening, and including a pressurizing unit fixing the development cartridge to the mounting portion by providing pressing force to the development cartridge in a direction parallel to a center line connecting centers of the photoconductive drum and development roller while the opening is closed.

The pressurizing unit may include first and second pressurizing units providing first and second pressing forces to the development cartridge by being spaced apart from the center line in opposite directions respectively by first and second distances.

The second pressing force may generate a moment in an opposite direction from a moment of rotation generated by rotation of the development roller, and the second pressing force may be larger than the first pressing force.

The second distance may be longer than the first distance.

The first pressurizing unit may include a plurality of first pressurization portions spaced apart from each other in a length direction of the photoconductive drum, and the second pressurizing unit may include a plurality of second pressurization portions spaced apart from each other in the length direction of the photoconductive drum.

The development cartridge may include a memory unit including a first contact portion, wherein the memory unit may be electrically connected to the body to transfer information about the development cartridge to the body, and one of the plurality of first and second pressurization portions may be a second contact portion electrically connected to the first contact portion.

First and second gears engaged with each other may be respectively provided at one sides of a rotation shaft of the photoconductive drum and a rotation shaft of the development roller, and a pressurization portion functioning as the second contact portion from among the plurality of first and second pressurization portions may be disposed at a location where the first and second gears are not disposed.

The pressurizing unit may include a plurality of pressurization portions spaced apart from each other in a length direction of the photoconductive drum, and the development cartridge may include a plurality of pressure-receiving portions corresponding to the plurality of pressurization portions.

One of the plurality of pressure-receiving portions may be a plurality of first contact portions for communication with the body, and the plurality of first contact portions may receive pressing forces from the plurality of pressurization portions.

First and second gears engaged with each other may be respectively provided at one sides of a rotation shaft of the photoconductive drum and a rotation shaft of the development roller, and the plurality of first contact portions may be a pressure-receiving portion disposed at a location where the first and second gears are not disposed, from among the plurality of pressure-receiving portions.

A pressurization portion corresponding to the plurality of first contact portions, from among the plurality of pressurization portions may be a plurality of second contact portions pressurizing and contacting the plurality of first contact portions.

The plurality of pressurization portions may include a plurality of first and second pressurization portions which are disposed opposite to each other based on the center line, and wherein the plurality of pressure-receiving portions may include a plurality of first and second pressure-receiving portions, which are disposed opposite to each other based on the center line.

According to an aspect of the present invention, there is provided a development cartridge mounted in a mounting portion provided in a photoreceptor cartridge including a photoreceptor after the photoreceptor cartridge is mounted in a body of an image forming apparatus, and including a development roller for developing an image by supplying toner to the photoreceptor, wherein the development cartridge include a plurality of pressure-receiving portions receiving pressing force in a direction parallel to a center line connecting centers of the development roller and photoreceptor.

The development roller may be included at a front region of the development cartridge based on a mounting direction of the development cartridge mounted in the body, and the plurality of pressure-receiving portions may be included at a rear region of the development cartridge.

The development cartridge may further include a handle for detaching the development cartridge, wherein the handle may be disposed at a rear center of the development cartridge.

At least one of the plurality of pressure-receiving portions may be included at each side of the handle.

The plurality of pressure-receiving portions may be arranged in a length direction of the photoreceptor.

The plurality of pressure-receiving portions may include pluralities of first and second pressure-receiving portions disposed opposite to each other based on the center line.

The development cartridge may include a memory unit electrically connected to the body to transfer information about the development cartridge to the body and include a plurality of contact portions for communication with the body, wherein the plurality of contact portions may be one of the plurality of pressure-receiving portions.

The development cartridge may include a gear disposed at one side of the development cartridge to transfer driving power from the body to the development roller, wherein the plurality of pressure-receiving portions may be arranged in a length direction of the photoreceptor, and the plurality of contact portions may be a pressure-receiving portion that is disposed opposite to a location where the gear is disposed, in the length direction from among the plurality of pressure-receiving portions.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
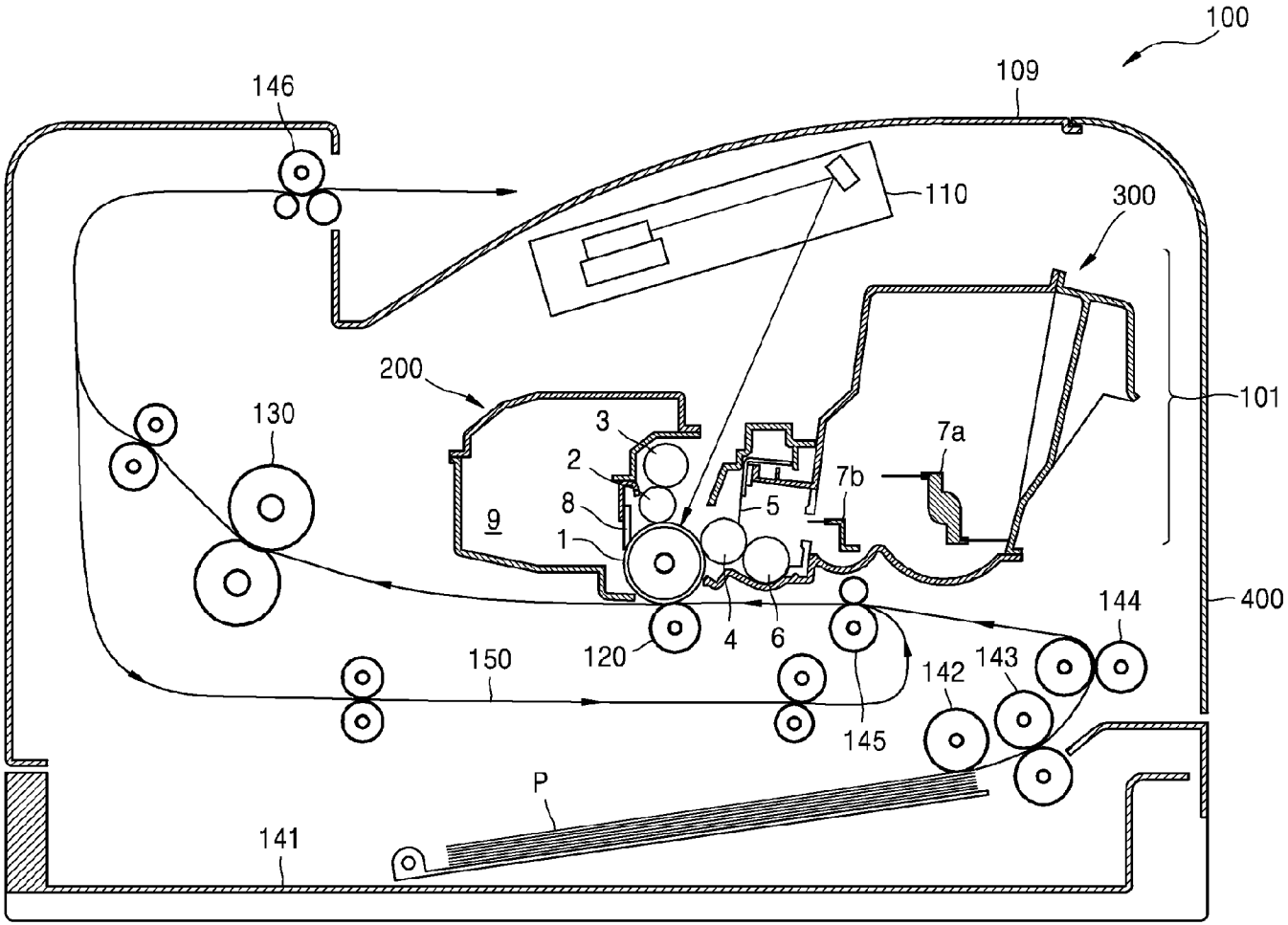
FIG. 1 illustrates an electrophotographic image forming apparatus according to an exemplary embodiment of the present invention.

Exemplary embodiments of present invention are described more fully with reference to the accompanying drawings, in which exemplary embodiments of the present invention are shown. In the drawings, like reference numerals denote like elements.

Figure 2A:
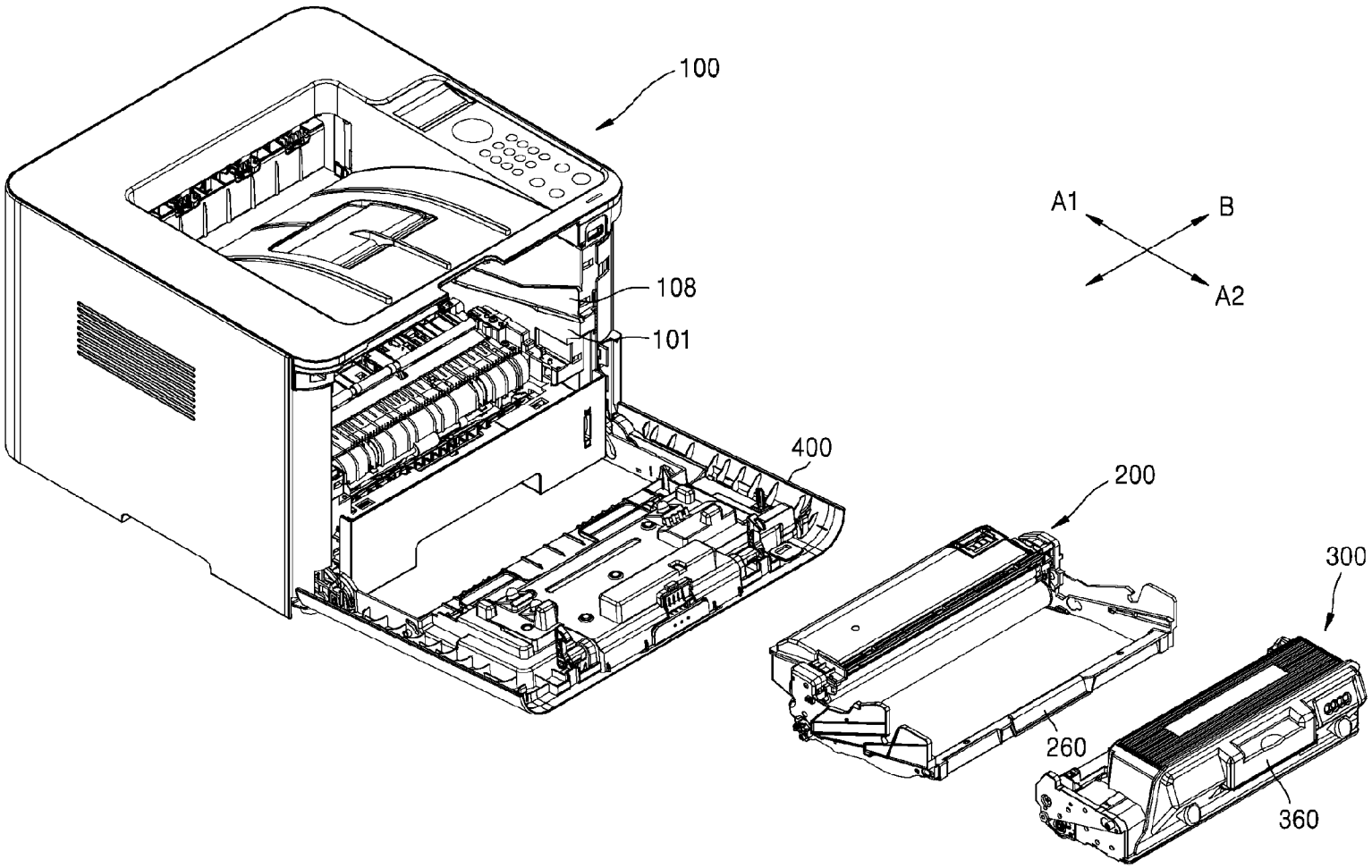
FIG. 2A illustrates an electrophotographic image forming apparatus, wherein a photoreceptor cartridge and a development cartridge are removed from a body, according to an exemplary embodiment of the present invention.
Figure 2B:
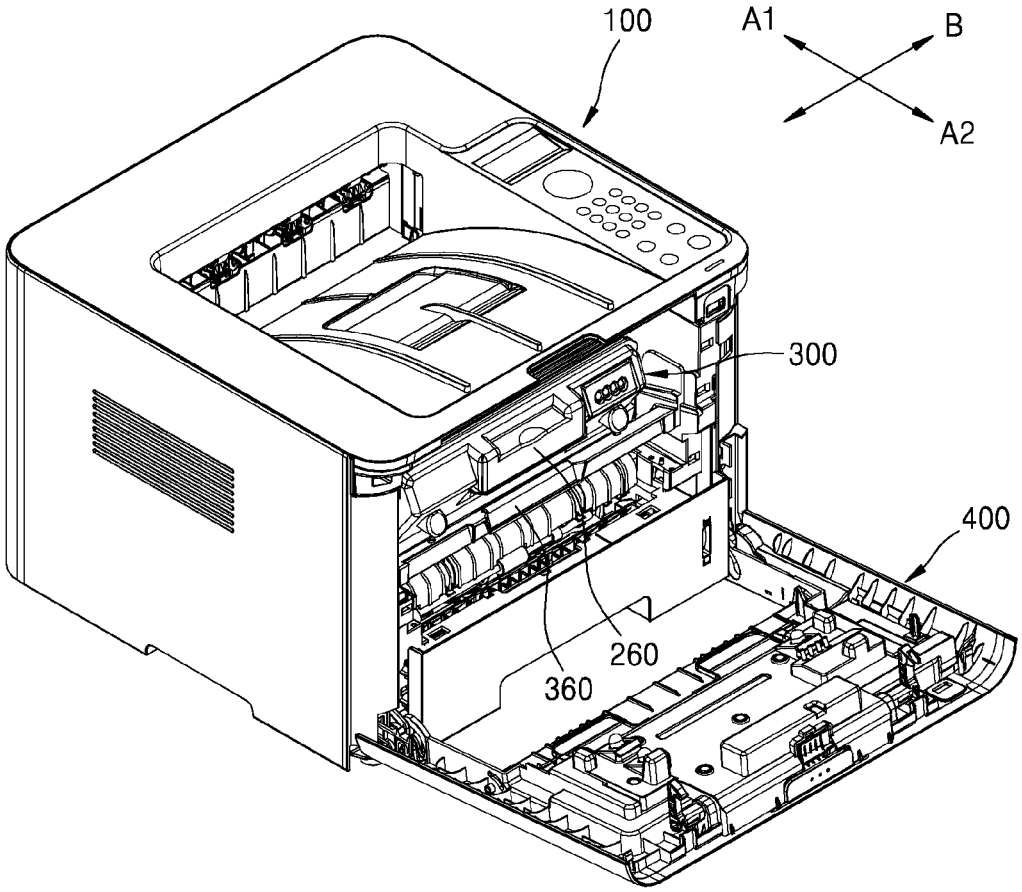
FIG. 2B illustrates the electrophotographic image forming apparatus of FIG. 1, wherein a photoreceptor cartridge and a development cartridge are mounted in a body, according to an embodiment of the present invention.

FIG. 1 illustrates an electrophotographic image forming apparatus according to an embodiment of the present invention. FIGS. 2A and 2B illustrate an exemplary electrophotographic image forming apparatus, wherein a photoreceptor cartridge 200 and a development cartridge 300 are removed from a body 100 in FIG. 2A and the photoreceptor cartridge 200 and the development cartridge 300 are mounted in the body 100 in FIG. 2B.

Referring to FIGS. 1, 2A, and 2B, the body 100, the photoreceptor cartridge 200, and the development cartridge 300 are illustrated. The body 100 includes an opening 101 providing a passage for the photoreceptor cartridge 200 and the development cartridge 300 to be mounted or removed. A cover 400 closes or opens the opening 101. The body 100 includes an exposure unit 110, a transfer roller 120, and a fusing unit 130. The body 100 includes a recording medium transfer structure for loading and transferring a recording medium P where an image is to be formed.

The photoreceptor cartridge 200 includes a photoconductive drum 1. The photoconductive drum 1 is an example of a photoreceptor, wherein an electrostatic latent image is formed on a surface thereof, and may include a conductive metal pipe and a photosensitive layer around the conductive metal pipe. A charging roller 2 is an example of a charger for charging the photoconductive drum 1 to have uniform surface potential. A charging brush or a corona charger may be used instead of the charging roller 2. A cleaning roller 3 may be used for removing foreign materials on a surface of the charging roller 2. A cleaning blade 8 is an example of a cleaning unit for removing toner and foreign materials on a surface of the photoconductive drum 1 after a transfer process described later. A cleaning apparatus having another shape, such as a rotating brush, may be used instead of the cleaning blade 8. The toner and foreign materials removed by the cleaning blade 8 may be contained in a waste toner container 9.

The development cartridge 300 supplies toner contained therein to an electrostatic latent image formed on the photoconductive drum 1 to develop the electrostatic latent image into a visible toner image. When a one-component development method is used, toner is contained in the development cartridge 300, and when a two-component development method is used, toner and a carrier are contained in the development cartridge 300. A development roller 4 is used to supply the toner in the development cartridge 300 to the photoconductive drum 1. A development bias voltage may be applied to the development roller 4. A regulator 5 constrains an amount of toner supplied from the development roller 4 to a development region where the photoconductive drum 1 and the development roller 4 face each other. The regulator 5 may be a doctor blade elastically contacting a surface of the development roller 4.

Figure 3A:
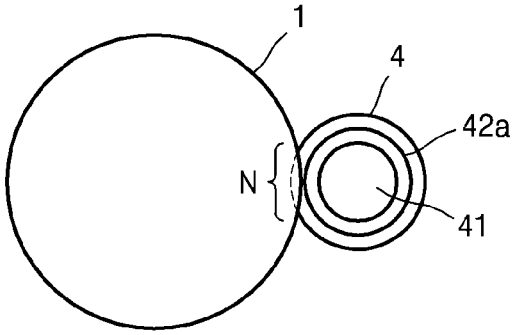
FIG. 3A illustrates an exemplary photoconductive drum and a development roller in a contact development method.
Figure 3B:
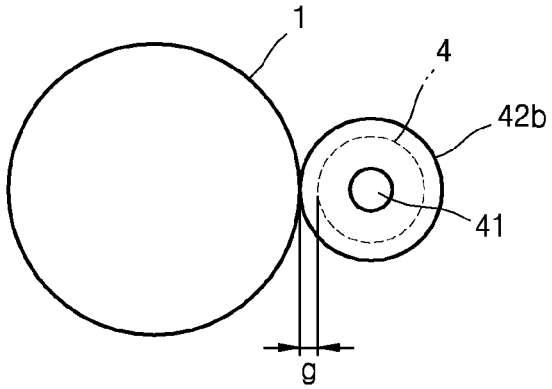
FIG. 3B illustrates an exemplary photoconductive drum and a development roller in a non-contact development method.

A one-component development method may be classified into a contact development method, wherein the development roller 4 and the photoconductive drum 1 are rotated while contacting each other, and a non-contact development method, wherein the development roller 4 and the photoconductive drum 1 are rotated by being spaced apart from each other by dozens to hundreds of microns. FIG. 3A illustrates an exemplary photoconductive drum 1 and the development roller 4 in the contact development method, and FIG. 3B illustrates an exemplary the photoconductive drum 1 and the development roller 4 in the non-contact development method. Referring to FIG. 3A, in the contact development method, gap maintaining member 42*a* having a smaller diameter than the development roller 4 may be provided on each of both ends of a rotation shaft 41 of the development roller 4. A contact amount of the development roller 4 to the photoconductive drum 1 may be constrained as the gap maintaining member 42*a* contacts the surface of the photoconductive drum 1. A development nip N may be formed as the development roller 4 contacts the photoconductive drum 1. Referring to FIG. 3B, in the non-contact development method, a gap maintaining member 42*b* having a larger diameter than the development roller 4 may be provided on each of the both ends of the rotation shaft 41 of the development roller 4. A development gap "g" between the development roller 4 and the photoconductive drum 1 may be constrained as the gap maintaining member 42*b* contacts the surface of the photoconductive drum 1. The development cartridge 300 may further include a supply roller 6 for adhering the toner to the surface of the development roller 4. A supply bias voltage may be applied to the supply roller 6. The development cartridge 300 may further include agitators 7*a* and 7*b* for stirring the toner and supplying the toner towards the supply roller 6 and the development roller 4. The agitators 7*a* and 7*b* may stir and triboelectrically charge the toner.

When a two-component development method is used, the development roller 4 may be spaced apart from the photoconductive drum 1 in the order of dozens to hundreds of microns. Although not illustrated, the development roller 4 may have a structure wherein a magnetic roller is disposed in a hollow cylindrical sleeve. The toner is adhered to a surface of a magnetic carrier. The magnetic carrier is adhered to the surface of the development roller 4 to be transferred to the development region where the photoconductive drum 1 and the development roller 4 face each other. Only the toner is supplied to the photoconductive drum 1 according to the development bias voltage applied between the development roller 4 and the photoconductive drum 1, and thus the electrostatic latent image formed on the surface of the photoconductive drum 1 is developed into the visible toner image. The development cartridge 300 may include a transport agitator (not shown) for mixing and stirring the toner and a carrier and transporting the mixture to the development roller 4. The transport agitator may be an auger, and a plurality of the transport agitators may be included in the development cartridge 300.

Examples of development methods of the electrophotographic image forming apparatus according to an embodiment are described, but the present invention is not limited thereto, and development methods may be variously modified and changed.

The exposure unit 110 forms the electrostatic latent image on the photoconductive drum 1 by irradiating light modulated according to image information to the photoconductive drum 1. The exposure unit 110 may be a laser scanning unit (LSU) using a laser diode as a light source, or a light-emitting diode (LED) exposure unit using an LED as a light source.

The transfer roller 120 is an example of a transfer unit for transferring a toner image from the photoconductive drum 1 to the recording medium P. A transfer bias voltage for transferring the toner image to the recording medium P may be applied to the transfer roller 120. A corona transfer unit or a transfer unit using a pin scorotron method may be used instead of the transfer roller 120.

The recording media P may be picked up one by one from a loading table 141 by a pickup roller 142, and are transferred to a region where the photoconductive drum 1 and the transfer roller 120 face each other by feed rollers 143, 144, and 145.

The fusing unit 130 applies heat and pressure to an image transferred to the recording medium P so as to fuse the image on the recording medium P. The recording medium P that passed through the fusing unit 130 is discharged outside the body 100 by a discharge roller 146.

According to an exemplary embodiment, the exposure unit 110 irradiates the light modulated according to the image information to the photoconductive drum 1 to develop the electrostatic latent image. The development roller 4 supplies the toner to the electrostatic latent image to form the visible toner image on the surface of the photoconductive drum 1. The recording medium loaded in the loading table 141 may be transferred to the region where the photoconductive drum 1 and the transfer roller 120 face each other by the pickup roller 142 and the feed rollers 143, 144, and 145, and the toner image is transferred on the recording medium P from the photoconductive drum 1 according to the transfer bias voltage applied to the transfer roller 120. After the recording medium P passes through the fusing unit 130, the toner image may be fused on the recording medium P according to heat and pressure. After the fusing, the recording medium P may be discharged by the discharge roller 146. When duplex printing is performed, after an imaged is printed on a front side of the recording medium P, the recording medium P is re-transferred to the region where the photoconductive drum 1 and the transfer roller 120 face each other along a reverse transfer path 150 as the discharge roller 146 is reverse-rotated. A new toner image may be transferred to and fused on a rear side of the recording medium P, and the recording medium P having duplex images may be discharged by the discharge roller 146.

The photoreceptor cartridge 200 and the development cartridge 300 are consumable products that are replaced after their lives are expired. Since lives of the photoreceptor cartridge 200 and the development cartridge 300 may be different, the photoreceptor cartridge 200 and the development cartridge 300 may be individually replaced.

A process cartridge, wherein the photoreceptor cartridge 200 and the development cartridge 300 are combined, may be mounted in, or removed from, the body 100. For example, when only the development cartridge 300 is to be replaced, the process cartridge is removed from the body 100, the combination of the photoreceptor cartridge 200 and the development cartridge 300 is released, a new development cartridge 300 is combined with the photoreceptor cartridge 200, and the process cartridge is mounted in the body 100. Accordingly, processes for replacing the development cartridge 300 are complex. Since a weight of the process cartridge is heavy, it is difficult to handle the process cartridge during mounting and removing processes.

According to an exemplary embodiment, the photoreceptor cartridge 200 is mounted in the body 100, and then the development cartridge 300 is mounted in a mounting portion 201 provided in the photoreceptor cartridge 200. When removing the photoreceptor cartridge 200 and the development cartridge 300, the photoreceptor cartridge 200 is removed from the body 100 after the development cartridge 300 is removed from the mounting portion 201. Accordingly, since the photoreceptor cartridge 200 and the development cartridge 300 may be individually mounted in, or removed from, the body 100, it is easy to replace the photoreceptor cartridge 200 or the development cartridge 300. Also, since the photoreceptor cartridge 200 and the development cartridge 300 are individually handled during the mounting and removing processes, user convenience may be improved as a burden of weights may be reduced.

The term "front" may be defined as a mounting direction A1 of the photoreceptor cartridge 200 and the development cartridge 300 is front, and the term "rear" may be defined as an opposite direction of the mounting direction A1, i.e., a removal direction A2.

Figure 4:
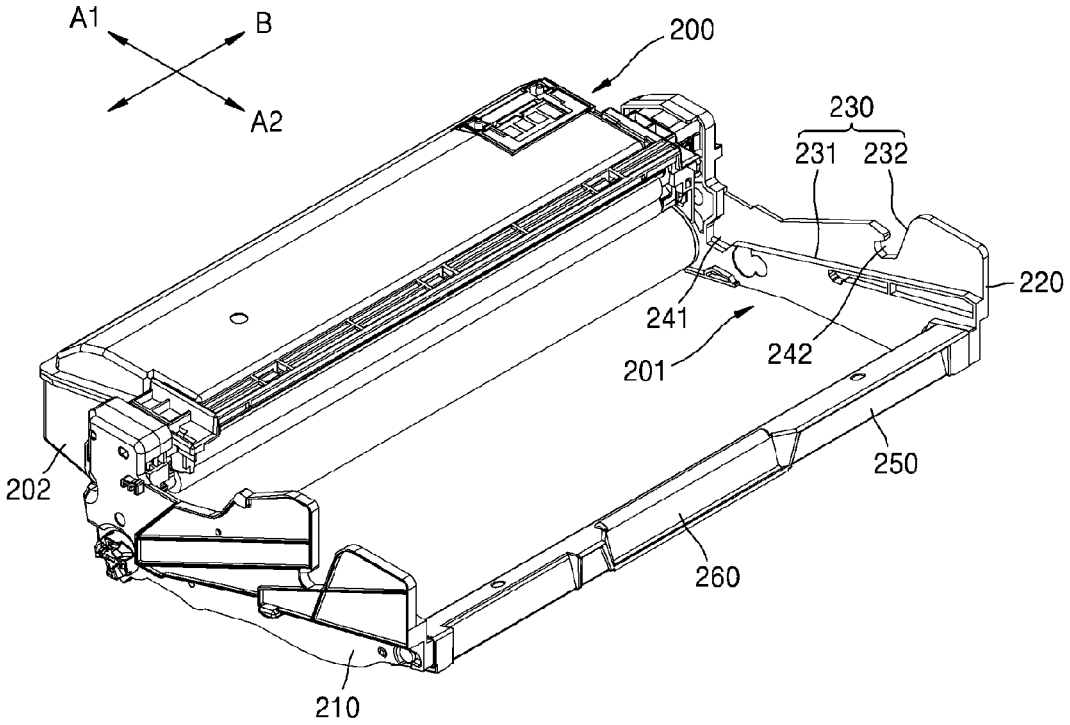
FIG. 4 illustrates a photoreceptor cartridge according to an embodiment of the present invention.
Figure 5A:
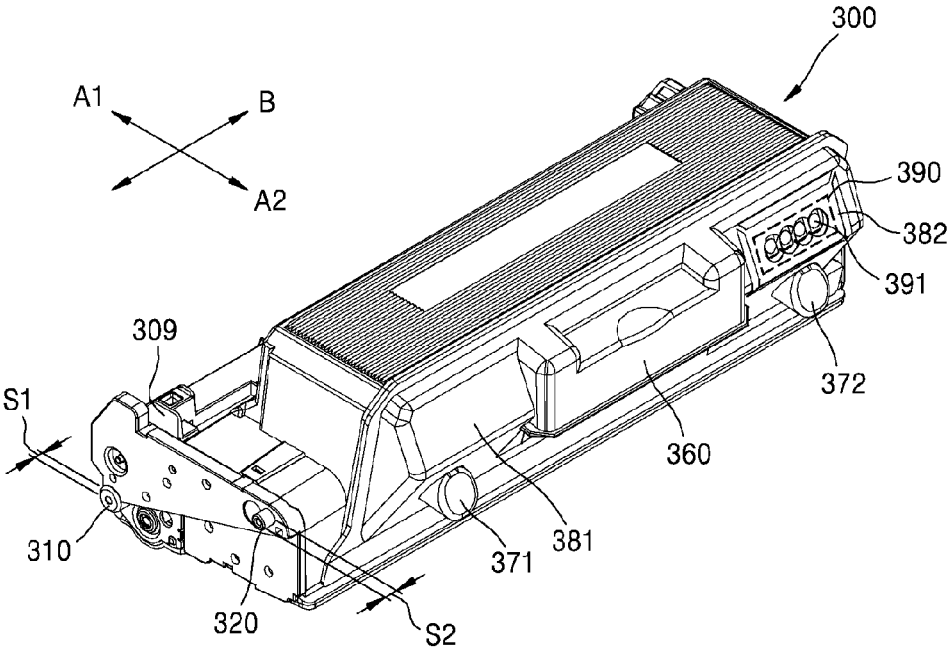
FIGS. 5A and 5B illustrate a development cartridge according to an embodiment of the present invention.
Figure 5B:
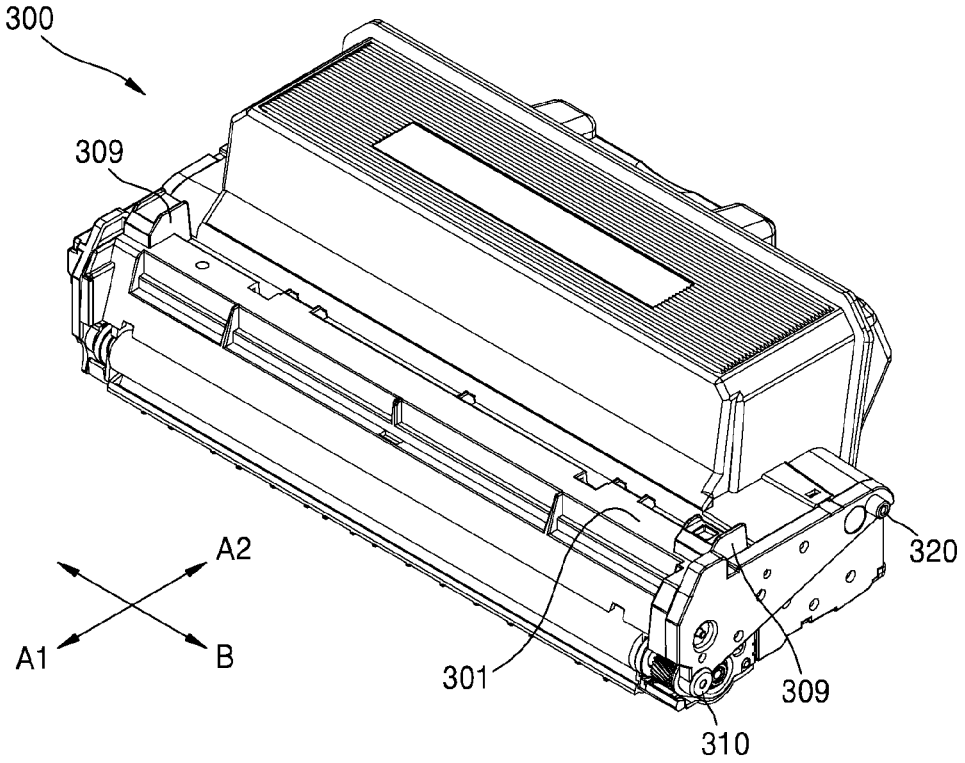

FIG. 4 illustrates the photoreceptor cartridge 200 according to an embodiment of the present invention. FIGS. 5A and 5B illustrate an exemplary development cartridge 300 according to an embodiment of the present invention. Referring to FIGS. 4, 5A, and 5B, the photoreceptor cartridge 200 includes the mounting portion 201 where the development cartridge 300 may be mounted. The mounting portion 201 may include, for example, first and second guide members 210 and 220 extending backwards respectively from both side portions of a frame 202 of the photoreceptor cartridge 200. The first and second guide members 210 and 220 may be connected to each other by a connecting member 250 extending in a length direction B of the photoconductive drum 1. The connecting member 250 may be connected to rear ends of the first and second guide members 210 and 220. Guide rails 230 may be in the first and second guide members 210 and 220. First and second guide protrusions 310 and 320 may be respectively on both side portions of the development cartridge 300. The second guide protrusion 320 may be disposed at a location spaced apart from the first guide protrusion 310. The development cartridge 300 may be mounted in, or removed from, the mounting portion 201 as the first and second guide protrusions 310 and 320 are supported by the guide rail 230.

The first guide protrusion 310 may operate as a location determining protrusion for determining a location of the development roller 4 with respect to the photoconductive drum 1 when the development cartridge 300 is mounted in the mounting portion 201 of the photoreceptor cartridge 200. For example, the first guide protrusion 310 may prevent the development cartridge 300 from being pushed backward by being supported by a retreat preventing portion 243 (see, for example, FIG. 7C) disposed at a rear portion of the first guide protrusion 310. The first guide protrusion 310 may be coaxial with the rotation shaft 41 of the development roller 4. Accordingly, since the location of the development roller 4 may be directly constrained, a location deviation of the development roller 4 due to manufacture tolerance or error may be reduced.

The second guide protrusion 320 may operate as a rotation preventing protrusion for preventing the development cartridge 300 from rotating with respect to the photoreceptor cartridge 200 when the photoreceptor cartridge 200 and the development cartridge 300 are driven during an image forming process. For example, the second guide protrusion 320 may prevent the development cartridge 300 from being rotated as a rotation direction of the development roller 4 is supported by a rotation preventing portion 244 (see, for example, FIG. 7C). In order to reduce a rotational force of the development cartridge 300, the first and second guide protrusions 310 and 320 may be guided by different rails. Accordingly, at least one of protrusion amounts and sizes (diameters) of the first and second guide protrusions 310 and 320 may be different. One or more exemplary embodiment of the first and second guide protrusions 310 and 320 and the guide rails 230 are disclosed.

Figure 6:
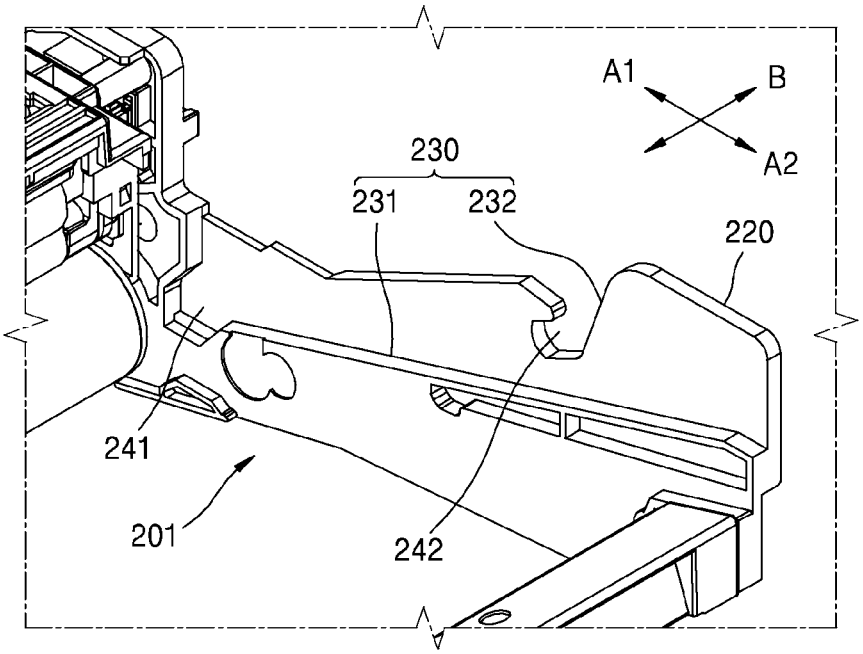
FIG. 6 illustrates a guide rail, according to an embodiment of the present invention.

FIG. 6 illustrates an exemplary guide rail 230, according to an embodiment of the present invention. Referring to FIG. 6, the guide rail 230 guides the first and second guide protrusions 310 and 320 respectively to first and second accommodation portions 241 and 242. The guide rail 230 may include a first guide rail 231 for guiding the first guide protrusion 310 to the first accommodation portion 241, and a second guide rail 232 for guiding the second guide protrusion 320 to the second accommodation portion 242. The first and second guide rails 231 and 232 may be spaced apart from each other in an up-and-down direction (for example, vertical direction), and may be independently formed. Protrusion amounts of the first and second guide protrusions 310 and 320 from two side walls of the development cartridge 300 may be different each other so that the first and second guide protrusions 310 and 320 are guided by the first and second guide rails 231 and 232, respectively. For example, the first and second guide protrusions 310 and 320 may have a boss shape externally protruding respectively from the both side portions of the development cartridge 300 in the length direction B. Referring to FIG. 5A, a protrusion amount S2 of the second guide protrusion 320 may be larger than a protrusion amount S1 of the first guide protrusion 310. The first and second guide protrusions 310 and 320 may be stepped in the length direction B of the first and second guide members 210 and 220. For example, the first guide rail 231 may protrude inwards from an inner wall of the first and second guide members 210 and 220, and the second guide rail 232 may have an engraved shape on the first and second guide members 210 and 220 or a slot shape penetrating through the first and second guide members 210 and 220. Accordingly, when the development cartridge 300 is mounted in the photoreceptor cartridge 200, the first guide protrusion 310 may be guided to the first accommodation portion 241 along the first guide rail 231, and the second guide protrusion 320 may be guided to the second accommodation portion 242 along the second guide rail 232. The first accommodation portion 241 may have a shape, for example, a U- or V-shape, such that the first guide protrusion 310 having a cylindrical shape may be inserted and accommodated therein. The second accommodation portion 242 may have a shape, for example, a lying U- or V-shape, such that the second guide protrusion 320 having a cylindrical shape is inserted and accommodated therein and does not leave from the second accommodation portion 242 upwardly. However, the shapes of the first and second accommodation portions 241 and 242 are not limited thereto.

Referring to FIG. 5B, a third guide protrusion 309 may be included at a front region of the development cartridge 300. For example, the third guide protrusion 309 may have a rib shape protruding upward from a top surface of a housing 301 of the development cartridge 300. A region of the third guide protrusion 309 contacting an entry guide 190 (see, for example, FIG. 7A) in the body 100 may be tilted with respect to the mounting direction A1 so that the development cartridge 300 is guided downward by the entry guide 190 as the development cartridge 300 is inserted into the mounting portion 201. A plurality of the third guide protrusions 309 spaced apart from each other in the length direction B may be in the development cartridge 300. When the development cartridge 300 is mounted in the mounting portion 201 of the photoreceptor cartridge 200 while the photoreceptor cartridge 200 is mounted in the body 100, the third guide protrusion 309 contacts the entry guide 190 included in the body 100. Accordingly, the development cartridge 300 is guided to the mounting portion 201. The second guide protrusion 320 may be guided by the second guide rail 232. The entry guide 190 may have, for example, a rib shape protruding inward from an upper cover 109 of FIG. 1 forming an upper external cover of the body 100, or may in a frame (not shown) forming the exposure unit 110 of FIG. 1.

Figure 7A:
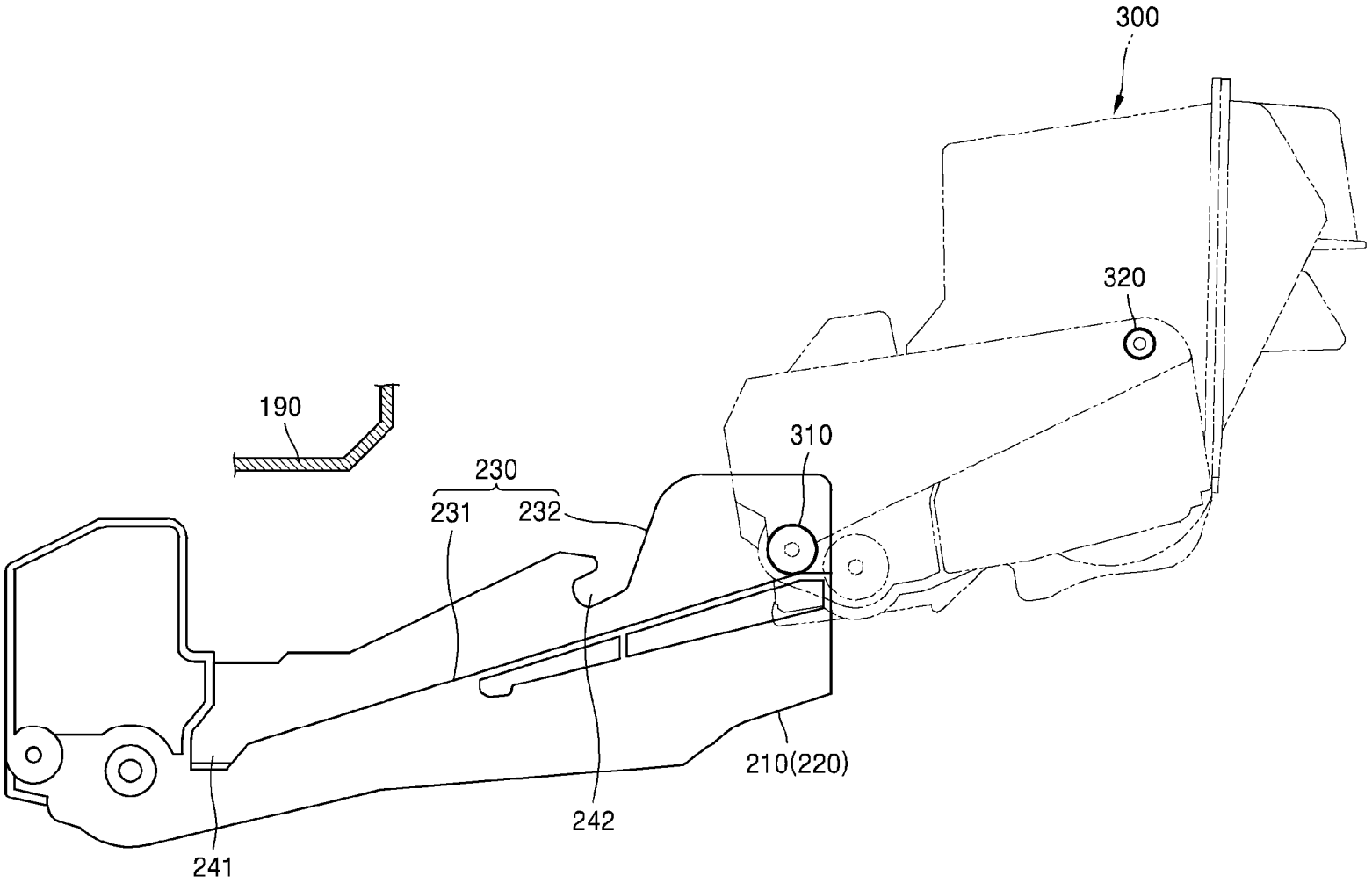
FIGS. 7A through 7C illustrate a process of mounting a development cartridge in a mounting portion after a photoreceptor cartridge is mounted in a body, according to an embodiment of the present invention.
Figure 7B:
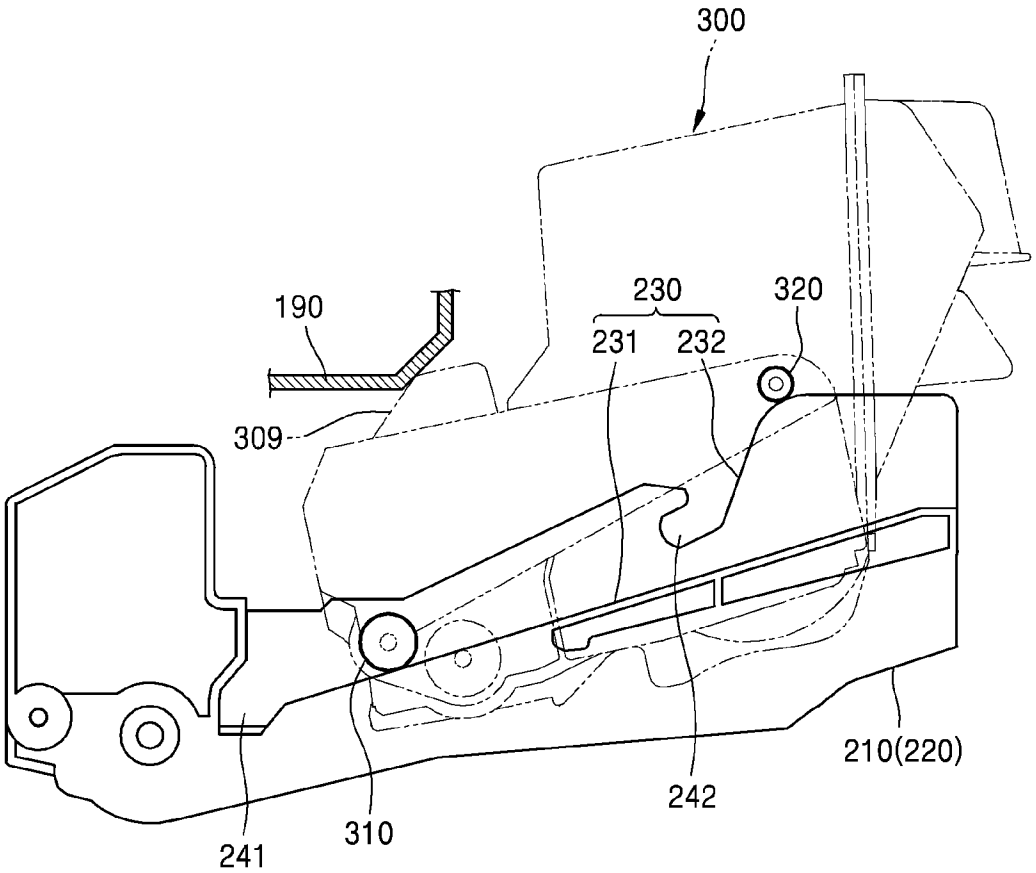
Figure 7C:
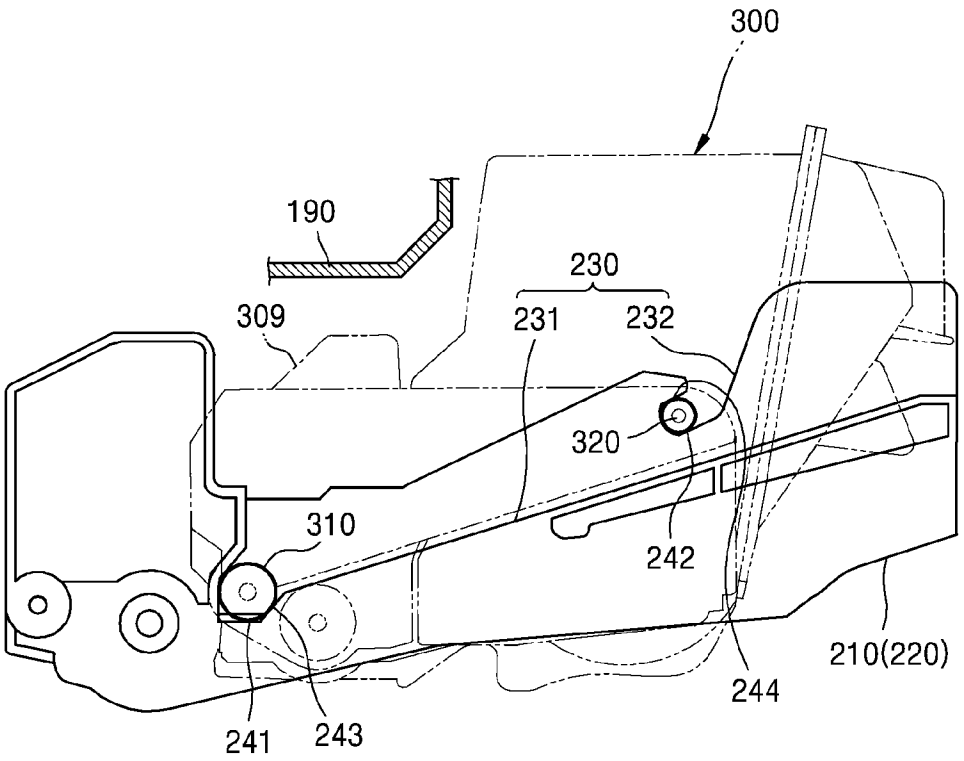

FIGS. 7A through 7C illustrate a process of mounting the development cartridge 300 in a mounting portion 201 after the photoreceptor cartridge 200 is mounted in the body 100, according to an embodiment of the present invention. As illustrated in FIG. 7A, while the photoreceptor cartridge 200 is mounted in the body 100, the development cartridge 300 is drawn near the body 100 so as to support the first guide protrusion 310 by the first guide rail 231. The development cartridge 300 may be pushed into the body 100. As the development cartridge 300 is inserted into the body 100, the third guide protrusion 309 contacts the entry guide 190, and as illustrated in FIG. 7B, the second guide protrusion 320 is guided to the second guide rail 232. When the development cartridge 300 is pushed in the mounting direction A1, the first and second guide protrusions 310 and 320 are respectively guided by the first and second guide rails 231 and 232 to be mounted in the first and second accommodation portions 241 and 242.

When a detaching direction of the development cartridge 300 and the photoreceptor cartridge 200 is perpendicular to a transfer direction of the recording medium P, i.e., is a length direction of the photoconductive drum 1, the photoconductive drum 1 and the development roller 4 may interfere with other components in the body 100 or the development cartridge 300 and the photoconductive drum 1 may interfere with each other, and thus a risk of the photoconductive drum 1 and the development roller 4 being damaged may be high, while the development cartridge 300 and the photoreceptor cartridge 200 are attached to, or detached from, the body 100. According to the electrophotographic image forming apparatus of an exemplary embodiment, the mounting direction A1 and the removal direction A2 of the photoreceptor cartridge 200 and the development cartridge 300 are the transfer direction of the recording medium P. In other words, the mounting direction A1 and the removal direction A2 are a transverse direction crossing the length direction B of the photoconductive drum 1 at right angles. Accordingly, the development roller 4 and the photoconductive drum 1 barely interfere with each other while mounting the development cartridge 300 in the mounting portion 201. Accordingly, a risk of breakage caused by interference between the development roller 4 and the photoconductive drum 1 may be reduced.

Even when the development cartridge 300 is mounted in the mounting portion 201 of the photoreceptor cartridge 200 after the photoreceptor cartridge 200 is mounted in the body 100, the development cartridge 300 is not fixedly combined to the photoreceptor cartridge 200. In other words, a user may remove the development cartridge 300 from the photoreceptor cartridge 200 and the body 100 by pulling the development cartridge 300 in a removal direction, without having to unlock the development cartridge 300 from the photoreceptor cartridge 200.

Referring to FIG. 4, a first handle 260 for the user to hold while mounting or removing the photoreceptor cartridge 200 in, or from, the body 100 may be included in the photoreceptor cartridge 200. The first handle 260 may be located at the opening 101, i.e., at the rear of the photoreceptor cartridge 200, so as to be easily located by the user when the cover 400 is opened. For example, the first handle 260 may be formed at a center of the connecting member 250 connecting the first and second guide members 210 and 220.

Referring to FIG. 5A, a second handle 360 for the user to hold while mounting or removing the development cartridge 300 in, or from, the body 100 may be included in the development cartridge 300. The second handle 360 may be located at the opening 101, i.e., at the rear of the development cartridge 300 so as to be easily located by the user when the cover 400 is opened. For example, the second handle 360 may be at a rear center of the development cartridge 300.

According to the electrophotographic image forming apparatus of an exemplary embodiment, when the photoreceptor cartridge 200 and the development cartridge 300 are removed from the body 100, the development cartridge 300 may be first removed from the mounting portion 201 of the photoreceptor cartridge 200, and then the photoreceptor cartridge 200 is removed from the body 100. Referring to FIG. 2B, the second handle 360 is located above the first handle 260 while the photoreceptor cartridge 200 and the development cartridge 300 are mounted in the body 100. Generally, an eye level of the user is generally higher than the electrophotographic image forming apparatus. A line of sight of the user looking into the body 100 through the opening 101 while the cover 400 of the body 100 is opened may be from top to bottom. Thus, the second handle 360 above the first handle 260 may be more easily found by the user, and the user may first hold the second handle 360 and remove the development cartridge 300.

Driving members such as the photoconductive drum 1 and the charging roller 2 provided in the photoreceptor cartridge 200, and the development roller 4, the supply roller 6, and the agitators 7*a* and 7*b* provided in the development cartridge 300 may be rotated by receiving driving power from a driving unit (not shown) included in the body 100, when the photoreceptor cartridge 200 and the development cartridge 300 are mounted in the body 100.

According to an electrophotographic image forming apparatus of an exemplary embodiment, e a development cartridge 300 is mounted in the mounting portion 201 in the photoreceptor cartridge 200. The photoreceptor cartridge 200 and the development cartridge 300 may be individually connected to the driving unit of the body 100. A mounting location of the development cartridge 300 in the body 100 may be multiply constrained, e.g., triply constrained by a location relationship between the photoreceptor cartridge 200 and the body 100, a location relationship between the development cartridge 300 and the mounting portion 201, and a location relationship between the development cartridge 300 and the driving unit included in the body 100. In other words, the mounting location of the development cartridge 300 in the body 100 may be over-constrained. Accordingly, when any one of the location relationships is not stable, the mounting location of the development cartridge 300 in the body 100 is unstable, and thus the development cartridge 300 may be twisted or vibrated when the development roller 4 is driven. The twisting or vibrating of the development cartridge 300 may be a reason for toner leakage. In the contact development method, the development roller 4 and the photoconductive drum 1 may not stably contact each other, and in the non-contact development method, an interval between the development roller 4 and the photoconductive drum 1 may not be uniformly maintained. Such an unstable location relationship between the photoconductive drum 1 and the development roller 4 may cause an image defect, such as an image omission or uneven image concentration. Since two driving couplers are required in the body 100 to transfer driving power to the photoreceptor cartridge 200 and the development cartridge 300, a driving structure becomes complex and the number of components are increased, thereby increasing material costs, assembly costs, and a size of the electrophotographic image forming apparatus.

according to an electrophotographic image forming apparatus of an exemplary embodiment, the driving power of the driving unit included in the body 100 may be transferred to the photoreceptor cartridge 200 and the development cartridge 300 along a path of the body 100, the photoreceptor cartridge 200, and the development cartridge 300.

Figure 8:
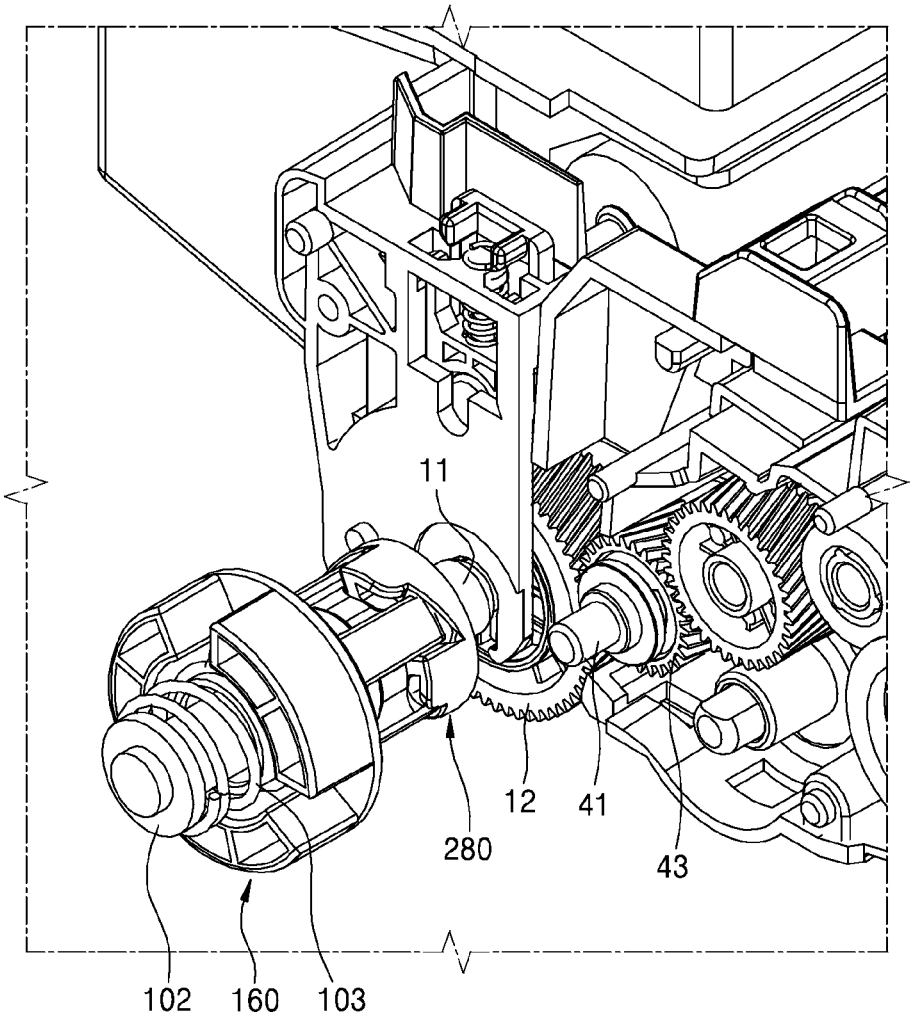
FIG. 8 illustrates a power connecting structure of a photoreceptor cartridge and a development cartridge, according to an embodiment of the present invention.

Referring to FIGS. 2A and 8, the photoreceptor cartridge 200 may be mounted in the body 100 by being guided by a mounting rail 108 included in the body 100. A first coupler 160 may be included in the body 100. The first coupler 160 may be formed as one or both side portions of the body 100. The first coupler 160 may be driven by a driving motor (not shown) in the body 100. A second coupler 280 may be included as one or both side portions of the photoreceptor cartridge 200. The second coupler 280 may be included at a rotation shaft 11 of the photoconductive drum 1 so that rotation power of the second coupler 280 is directly transferred to the photoconductive drum 1. The first coupler 160 may be supported by a shaft 102 included in the body 100 so that the first coupler 160 moves in an axial direction of the shaft 102. A spring 103 may apply elastic force to the first coupler 160 in a direction where the first coupler 160 is combined to the second coupler 180. When the photoreceptor cartridge 200 is mounted in the body 100, driving power may be transferred from the body 100 to the photoreceptor cartridge 200 as the first and second couplers 160 and 280 are mutually engaged. The structures of the first and second couplers 160 and 280 are not limited to those illustrated in FIG. 8. For example, any one of various power connecting structures, such as a gear-gear engaging structure, may be employed as the first and second couplers 160 and 280. The charging roller 2 may be driven by being connected to a first gear 12 via a gear connecting structure.

Referring to FIG. 8, the first gear 12 may be included in the rotation shaft 11 of the photoconductive drum 1, and a second gear 43 may be included in the rotation shaft 41 of the development roller 4. When the development cartridge 300 is mounted in the photoreceptor cartridge 200, the second gear 43 may be engaged to the first gear 12. The supply roller 6 and the agitators 7*a* and 7*b* may be driven by being connected to the second gear 43 via a gear connecting structure. Accordingly, the driving power may be transferred from the body 100 to the photoreceptor cartridge 200 and the development cartridge 300.

While the first and second guide protrusions 310 and 320 are mounted in the first and second accommodation portions 241 and 242, the gap maintaining member 42*a* does not yet contact the photoconductive drum 1 and the surfaces of the development roller 4 and photoconductive drum 1 contact each other but the development nip N is not formed, in the contact development method illustrated in FIG. 3A. Accordingly, in order for the development roller 4 and the photoconductive drum 1 to be in a state illustrated in FIG. 3A, the development cartridge 300 is pushed further until the gap maintaining member 42*a* contacts the photoconductive drum 1. In the non-contact development method of FIG. 3B, the gap maintaining member 42*b* contacts the photoconductive drum 1 and thus the development gap "g" is formed between the development roller 4 and the photoconductive drum 1 but the development cartridge 300 is not fixed. Accordingly, in order to maintain the location relationship between the development roller 4 and the photoconductive drum 1 to maintain the state illustrated in FIG. 3A or 3B, the development cartridge 300 needs to be pressurized to be fixed to the photoreceptor cartridge 200.

Figure 9:
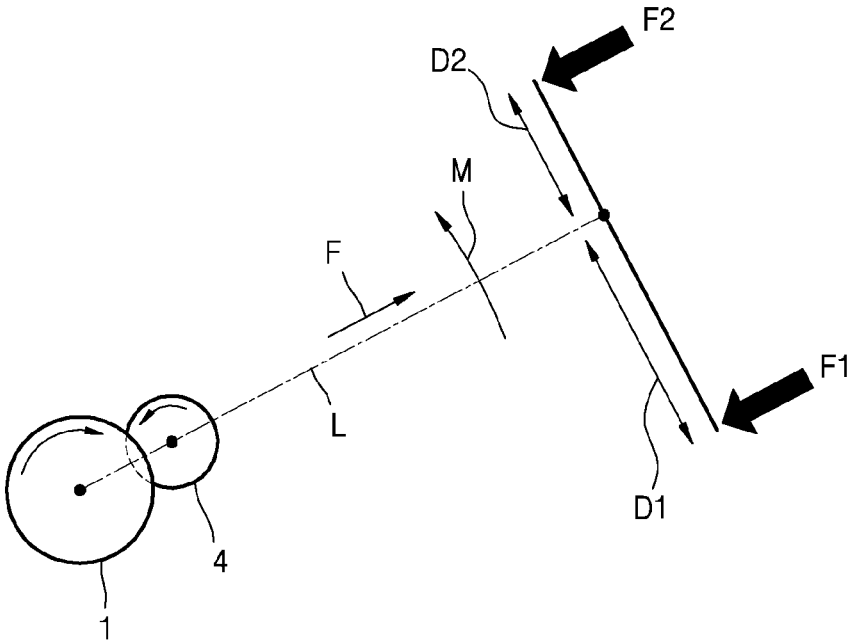
FIG. 9 illustrates a pressing force for fixing a development cartridge to a photoreceptor cartridge.

FIG. 9 illustrates a pressing force for fixing the development cartridge 300 to the photoreceptor cartridge 200. Referring to FIG. 9, when the contact development method is used, the development nip N is formed as the development roller 4 is compressively deformed, and force F in a retreating direction is applied to the development cartridge 300 due to repulsive force of the compressive deformation of the development roller 4. A moment of rotation M is applied to the development cartridge 300 in a rotation direction of the development roller 4. When the development cartridge 300 retreats due to the force F and the moment of rotation M, the development nip N (or the development gap "g") between the development roller 4 and the photoconductive drum 1 is no longer maintained, and thus an image may be blurrily printed or a white void may be generated. A jitter may be generated due to vibration of the development cartridge 300. Accordingly, the pressing force for compensating the force F and the moment of rotation M may be applied to the development cartridge 300.

Referring to FIG. 9, first and second pressing forces F1 and F2 may be applied to the development cartridge 300. The first and second pressing forces F1 and F2 may be applied to locations spaced apart from a center line L connecting centers of the photoconductive drum 1 and development roller 4 respectively by first and second distances D1 and D2. Directions of the first and second pressing forces F1 and F2 are parallel to the center line L and opposite to the force F. When the first and second pressing forces F1 and F2 form an angle with the center line L, the first and second pressing forces F1 and F2 may be lost since only components of the first and second pressing forces F1 and F2 parallel to the center line L operate as an effective pressing force for maintaining the development nip N (or the development gap g). A location of the development cartridge 300 may be unstable due to unnecessary moment of rotation generated by the first and second pressing forces F1 and F2. The sizes of the first and second pressing forces F1 and F2 need to be increased considering a loss of pressing force, and thus stresses of first and second pressurizing units 410 and 420 of FIG. 10 providing the first and second pressing forces F1 and F2 may be increased, thereby increasing a stress of the cover 400 where the first and second pressurizing units 410 and 420 may be included. A load for closing the cover 400 is increased, and thus the user may be inconvenient. Accordingly, in an exemplary embodiment, the directions of the first and second pressing forces F1 and F2 are parallel to the center line L connecting the centers of the photoconductive drum 1 and the development roller 4. As such, the sizes of the first and second pressing forces F1 and F2 are optimized, and thus the location stability of the development cartridge 300 and user convenience may be obtained, and stresses of components may be reduced.

The first pressing force F1 may be applied to a location spaced apart from the center line L of the development cartridge 300 by the first distance D1 and opposite to the second pressing force F2 based on the center line L. Only the first pressing force F1 may be applied to the development cartridge 300 in order to compensate for the moment of rotation M and the force F, but in this case, strong pressing force is focused on one location, and thus the stresses of the development cartridge 300 and the first pressurizing unit 410 may be increased. When the thickness of the development cartridge 300 is high, it may be difficult to balance a moment of rotation applied to the development cartridge 300 only by using the first pressing force F1. Accordingly, the second pressing force F2 may be applied to the opposite side based on the center line L so as to reduce the sizes of the first and second pressing forces F1 and F2 for compensating for the force F while easily balancing the moment of rotation. The size of the first pressing force F1 may be larger than the size of the second pressing force F2 in order to compensate for the moment of rotation M and a moment of rotation by the second pressing force F2. By setting the first distance D1 to be larger than the second distance D2, the size of the first pressing force F1 for compensating for the moment of rotation M and the moment of rotation by the second pressing force F2 may be decreased as small as possible. Accordingly, the sizes of the first and second pressing forces F1 and F2 may be reduced, thereby reducing the stresses of the development cartridge 300 and the first and second pressurizing units 410 and 420.

A total moment Mt applied to the development cartridge 300 by the first and second pressing forces F1 and F2 may be obtained according to an equation (1):

$$M+F2\times D2-F1\times D1=Mt \qquad \text{Equation (1).}$$

By setting F1, F2, D1, and D2 in equation (1) such that the total moment Mt is decreased, the location stability of the development cartridge 300, i.e., the location stabilities of the development roller 4 and photoconductive drum 1 may be obtained by using a minimum pressing force.

According to the electrophotographic image forming apparatus of an exemplary embodiment, by pressurizing the development cartridge 300 in the mounting direction A1 by closing the cover 400, the development cartridge 300 is fixed to the photoreceptor cartridge 200 while maintaining the development roller 4 and the photoconductive drum 1 in the locations illustrated in FIG. 3A or 3B.

Figure 10:
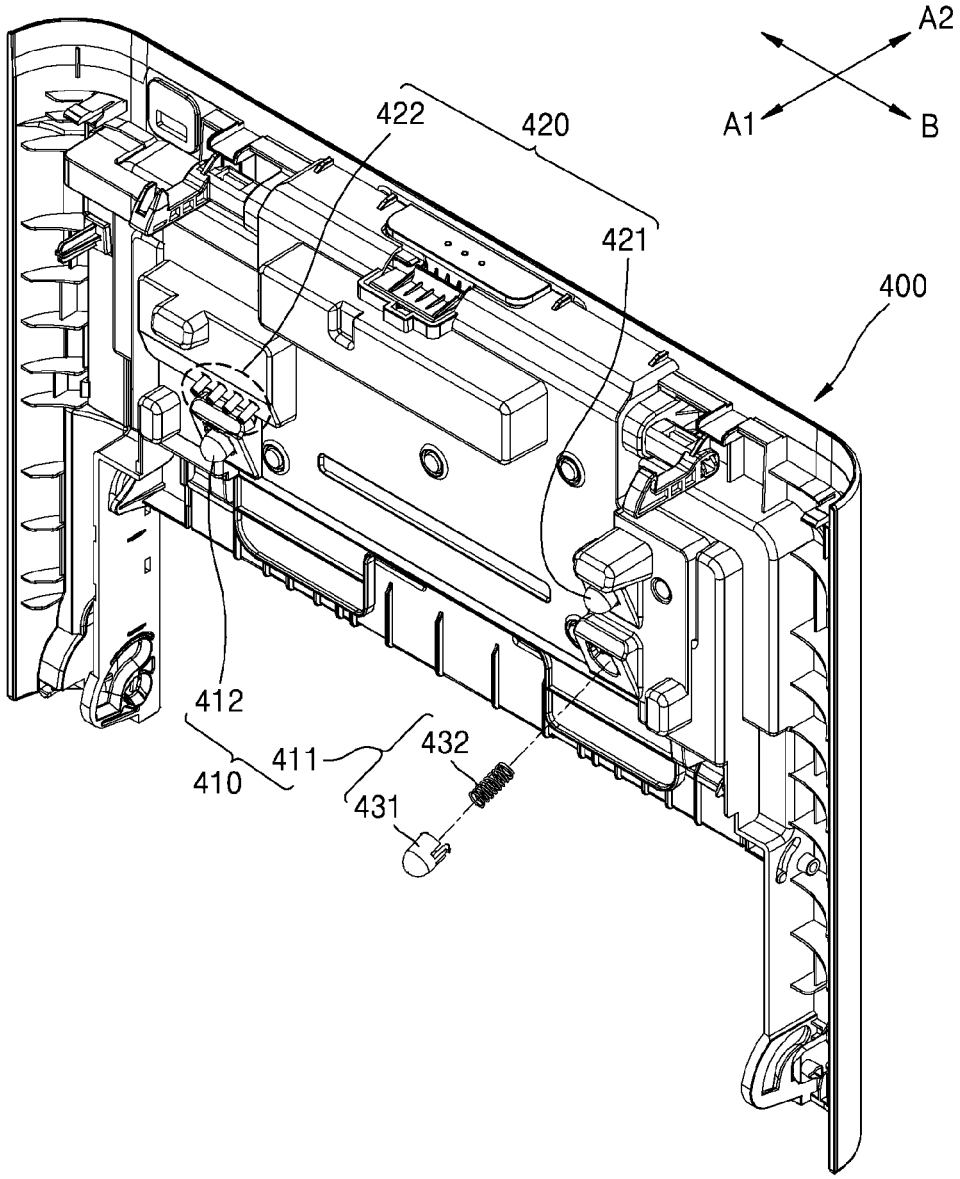
FIG. 10 illustrates a cover according to an embodiment of the present invention.
Figure 11:
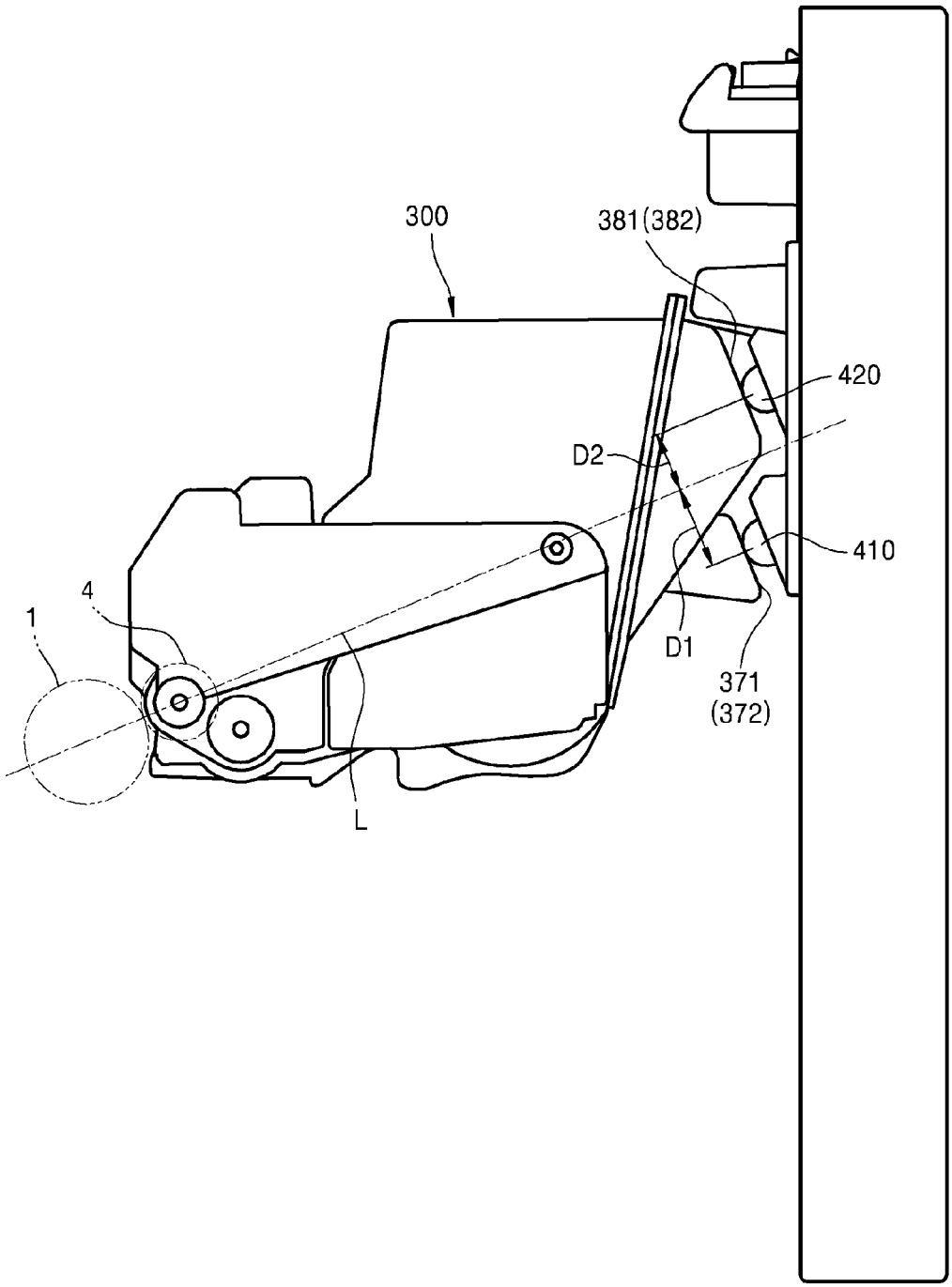
FIG. 11 illustrates a development cartridge being pressurized by a pressurization portion while a cover is closed, according to an embodiment of the present invention.

FIG. 10 illustrates the cover 400 according to an embodiment of the present invention. FIG. 11 illustrates a state of the development cartridge 300 being pressurized while the cover 400 is closed, according to an embodiment of the present invention. Referring to FIGS. 10 and 11, the first and second pressurizing units 410 and 420 are included in the cover 400. The first and second pressurizing units 410 and 420 are disposed opposite to each other based on the center line L. The first pressurizing unit 410 is spaced apart from the center line L by the first distance D1 so as to apply the first pressing force F1 to the development cartridge 300 when the cover 400 is closed. The second pressurizing unit 420 is spaced apart from the center line L by the second distance D2 so as to apply the second pressing force F2 to the development cartridge 300 when the cover 400 is closed.

The first pressurizing unit 410 includes a plurality of first pressurization portions, for example, two first pressurization portions 411 and 412 spaced apart from each other in the length direction B. The second pressurizing unit 420 includes a plurality of second pressurization portions, for example, two second pressurization portions 421 and 422 spaced apart from each other in the length direction B. As such, by preparing the two first pressurization portions 411 and 412 and the two second pressurization portions 421 and 422, which are spaced apart from each other in the length direction B, so as to provide the first and second pressing forces F1 and F2, the first and second pressing forces F1 and F2 may be easily balanced in the length direction B. Since sizes of pressing forces applied respectively by the first pressurization portions 411 and 412 and the second pressurization portions 421 and 422 may be reduced, stresses applied to the cover 400 and the development cartridge 300 may be reduced.

The first and second gears 12 and 43 may be located only on one side of the length direction B of the photoconductive drum 1 and the development roller 4. Forces applied to the development cartridge 300 as the first and second gears 12 and 43 rotate may differ at a location where the first and second gears 12 and 43 are disposed and at a location where the first and second gears 12 and 43 are not disposed. For example, a force dragging the second gear 43 towards the first gear 12, i.e., a force pulling the development cartridge 300 in the mounting direction A1 may be applied according to the rotation of the first and second gears 12 and 43 at the location where the first and second gears 12 and 43 are disposed. Considering such a configuration, pressing forces of the first and second pressurization portions 411 and 421 disposed at the location where the first and second gears 12 and 43 are disposed may be smaller than pressing forces of the first and second pressurization portions 412 and 422 disposed at the location where the first and second gears 12 and 43 are not disposed. As such, by arranging the first pressurization portions 411 and 412 and the second pressurization portions 421 and 422 in the length direction B, the development cartridge 300 may be further stably fixed to the photoreceptor cartridge 200.

Each of the first pressurization portions 411 and 412 and the second pressurization portions 421 and 422 may include, for example, a pressurization member 431 for pressurizing the development cartridge 300, and an elastic member 432 for providing elastic force to the pressurization member 431 to push the development cartridge 300.

Referring to FIGS. 5A and 11, a first pressure-receiving unit (first pressure-receiving portions 371 and 372) and a second pressure-receiving unit (second pressure-receiving portions 381 and 382) respectively corresponding to the first pressurizing unit 410 (the first pressurization portions 411 and 412) and the second pressurizing unit 420 (the second pressurization portions 421 and 422) may be included at the rear portion of the development cartridge 300. The first pressure-receiving portions 371 and 372 and the second pressure-receiving portions 381 and 382 may be located in planes perpendicular to the center line L. The first pressure-receiving portions 371 and 372 and the second pressure-receiving portions 381 and 382 may be disposed opposite to each other based on the center line L. At least one pressure-receiving portion may be disposed at each side of the second handle 360 in the length direction B of the photoconductive drum 1. Accordingly, when the cover 400 is closed, as illustrated in FIG. 11, after mounting the development cartridge 300 in the mounting portion 201 of the photoreceptor cartridge 200 mounted in the body 100, the first and second pressing forces F1 and F2 are respectively applied to the first pressure-receiving portions 371 and 372 and the second pressure-receiving portions 381 and 382 by the first pressurization portions 411 and 412 and the second pressurization portions 421 and 422. The development cartridge 300 may be fixed to the photoreceptor cartridge 200 by pressing force, and as illustrated in FIG. 3A or 3B, the gap maintaining member 42*a* or 42*b* may maintain contact with the photoconductive drum 1.

By fixing the development cartridge 300 to the mounting portion 201 by closing the cover 400, a locking apparatus or the like for fixing the development cartridge 300 to the photoreceptor cartridge 200 does not need to be separately included in the development cartridge 300 or the photoreceptor cartridge 200, and thus material costs may be reduced. Since the combination of the development cartridge 300 and the photoreceptor cartridge 200 may be maintained/released only by opening and closing the cover 400, processes of mounting/detaching the development cartridge 300 and the photoreceptor cartridge 200 may be simplified, and thus user convenience may be improved. By dividing pressing force for pressurizing the development cartridge 300 into the first and second pressing forces F1 and F2 based on the center line L connecting the centers of the photoconductive drum 1 and development roller 4, positional stability of the development cartridge 300 may be improved by compensating for the force F and the moment of rotation M, thereby stably maintaining the development nip N (or the development gap g).

Referring to FIG. 5A, a memory unit 390 may be included in the development cartridge 300. When the development cartridge 300 is mounted in the body 100, the memory unit 390 may be electrically connected to the body 100 to transmit information about the development cartridge 300 to the body 100. Various types of information about the development cartridge 300 may be stored in the memory unit 390. For example, the memory unit 390 may store information about a manufacturer, information about a manufacture date, a serial number, intrinsic information like a model name, and information about a use state (for example, how many sheets of paper has been printed, how many printable pages are left, and how much toner is left).

A plurality of first contact portions 391 for communication between the memory unit 390 and the body 100 may be included in the development cartridge 300. A plurality of second contact portions electrically connected to the first contact portions 391 may be in the cover 400. For example, the numbers of each of the first contact portions 391 and the second contact portions may be equal to, or higher than, 4. The first contact portion 391 may be included in any one of the first pressure-receiving portions 371 and 372 and the second pressure-receiving portions 381 and 382. Any one of the first pressurization portions 411 and 412 and the second pressurization portions 421 and 422 may operate as the second contact portion. Accordingly, by operating the first pressurization portion 412 as the second contact portion, manufacturing costs of the electrophotographic image forming apparatus may be reduced.

Figure 12:
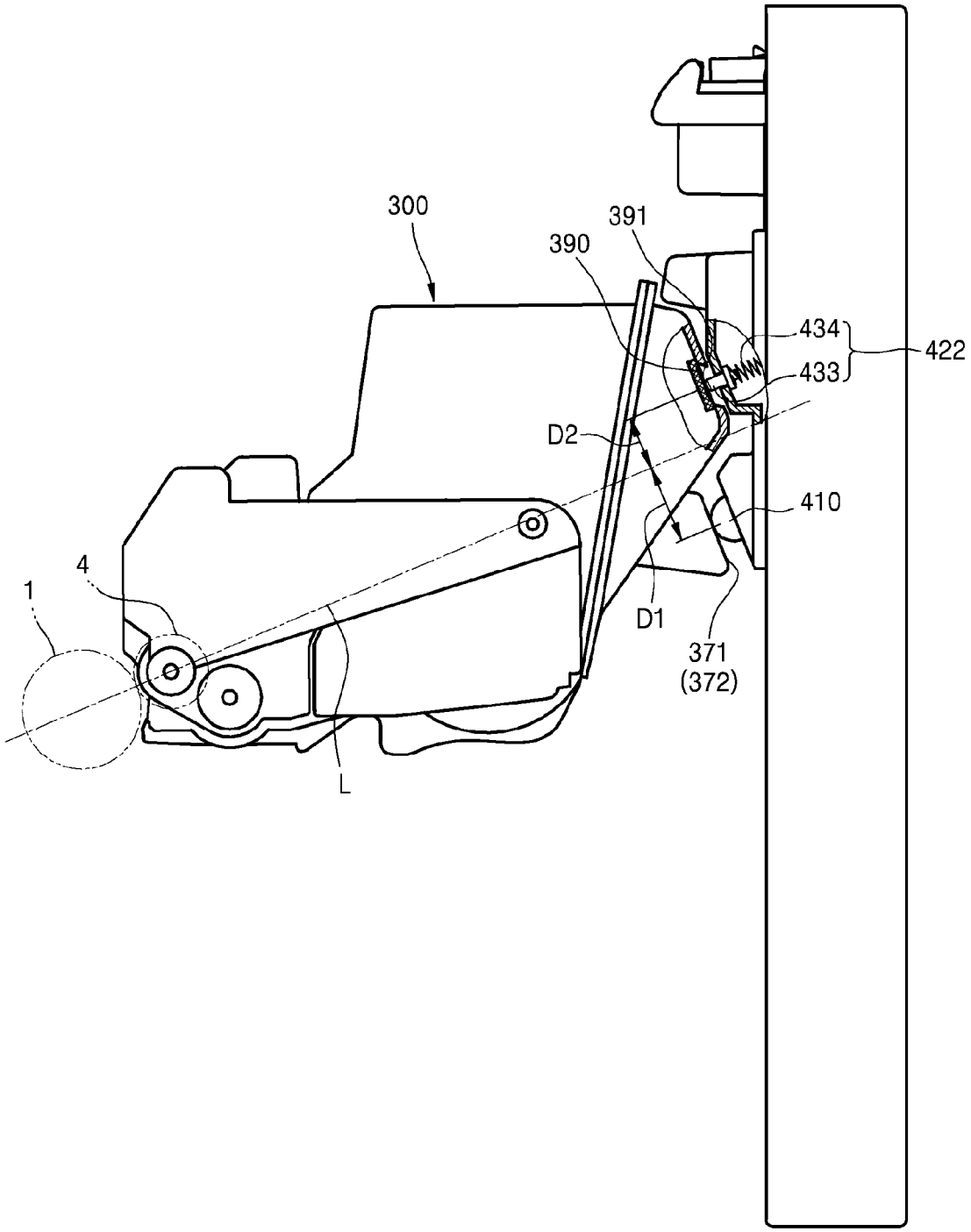
FIG. 12 illustrates a state of a pressurization portion also performing a communication function with a memory unit, according to an embodiment of the present invention.

Referring to FIGS. 10 and 12, the second contact portion may include a connection pin 433 and an elastic member 434 applying elastic force to the connection pin 433 in a direction contacting the first contact portion 391. The elastic force applied by the plurality of second contact portions fix the development cartridge 300 to the mounting portion 201. The pressing force applied to the development cartridge 300 may be higher at the location where the first and second gears 12 and 43 are provided than the location where the first and second gears 12 and 43 are not provided. Thus, the first contact portion 391 and the second contact portion may be disposed at a location where the pressing force is high based on the length direction B. Referring to FIGS. 5A, 10, and 12, according to an exemplary embodiment, the first contact portion 391 may be included at the second pressure-receiving portion 382 located at the location where the first and second gears 12 and 43 are not provided. The second pressurization portion 422 located at the location where the first and second gears 12 and 43 are provided operates as the second contact portion. Accordingly, the pressing force contacting the first contact portion 391 and the second contact portion may be effectively used as pressing force fixing the development cartridge 300 to the mounting portion 201, and may stably pressurize the development cartridge 300 by balancing pressing force in the length direction B.

Referring to FIG. 7C, when the development cartridge 300 is mounted in the photoreceptor cartridge 200, the first and second guide protrusions 310 and 320 may be located in the first and second accommodation portions 241 and 242. When the cover 400 is closed, the development cartridge 300 is pushed in the mounting direction A1 by the first and second pressurizing units 410 and 420 and thus the development roller 4 and the photoconductive drum 1 reach the locations illustrated in FIG. 3A or 3B, and the development cartridge 300 no longer moves in the mounting direction A1. The development roller 4 rotates as the second gear 43 provided at the rotation shaft 41 of the development roller 4 and the first gear 12 provided at the rotation shaft 11 of the photoconductive drum 1 are engaged. In the contact development method, a repulsive force F resulting from the compressive deformation of the development roller 4 may be applied to the development cartridge 300. The pushing out (retreating) of the development cartridge 300 due to the repulsive power F causes an engaged amount of the first and second gears 12 and 43 to be reduced, a contact amount of the development roller 4 and the photoconductive drum 1 to be reduced when the contact development method is used, and the interval between the development roller 4 and the photoconductive drum 1 to be increased when the non-contact development method is used. As a result, an image omission or an image defect caused by faulty rotation of the development roller 4 may be generated. According to an exemplary embodiment, in order to prevent the development cartridge 300 from being pushed, the first accommodation portion 241 may include a retreat preventing portion 243 located at the rear portion of the first guide protrusion 310 to support the first guide protrusion 310. The first guide protrusion 310 operates as a location determining protrusion for determining a mounting location of the development cartridge 300, and a location error of the development roller 4 may be reduced by forming the first guide protrusion 310 to be coaxial with the rotation shaft 41 of the development roller 4.

The second guide protrusion 320 may be located in the second accommodation portion 242. When the first and second gears 12 and 43 rotate, the moment of rotation M is applied to the development cartridge 300. In order to prevent the development cartridge 300 from rotating, the second accommodation portion 242 includes a rotation preventing portion 244 supporting the second guide protrusion 320 by being located at a downstream of the second guide protrusion 320 in the rotation direction of the first gear (or the development roller 4). The second guide protrusion 320 operates as a rotation preventing protrusion of the development cartridge 300.

Accordingly, the development cartridge 300 may maintain a stable position without being retreated or rotated while the development roller 4 rotates, and a relative location of the photoconductive drum 1 and the development roller 4 may be stably maintained.

Figure 13:
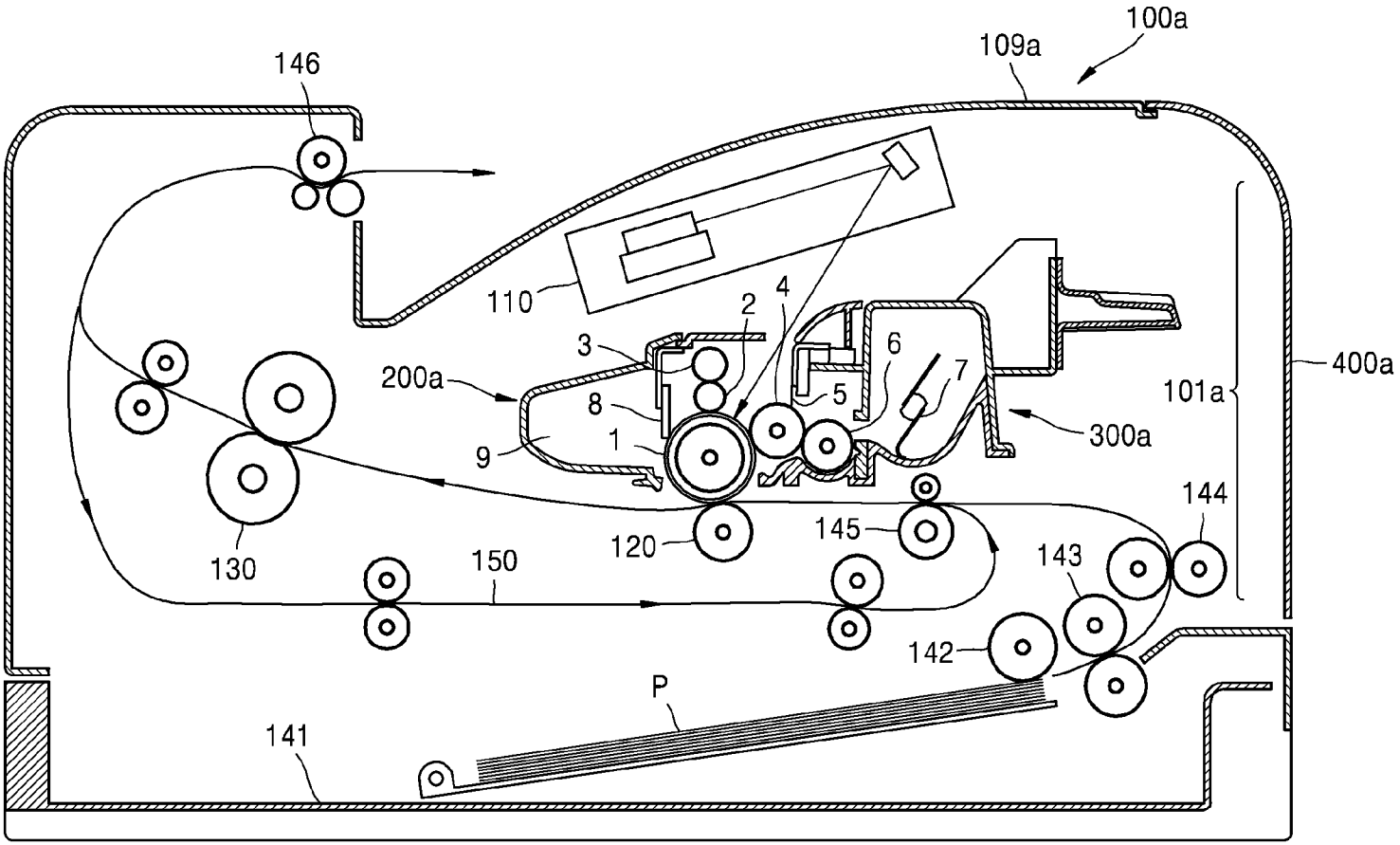
FIG. 13 illustrates an electrophotographic image forming apparatus according to an embodiment of the present invention.
Figure 14:
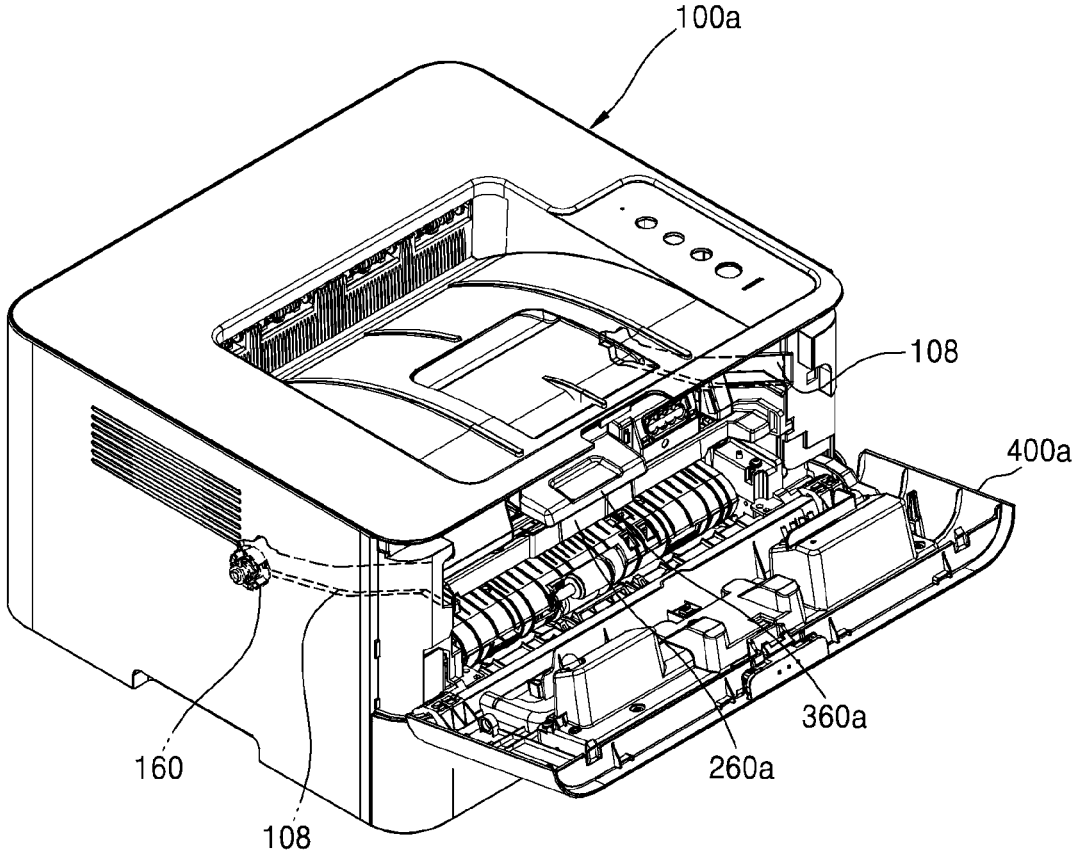
FIG. 14 illustrates an electrophotographic image forming apparatus, wherein a photoreceptor cartridge and a development cartridge are mounted in a body.

FIG. 13 illustrates an electrophotographic image forming apparatus according to an embodiment of the present invention, and FIG. 14 illustrates the electrophotographic image forming apparatus of FIG. 13.

A body 100*a*, a photoreceptor cartridge 200*a*, and a development cartridge 300*a* are illustrated in FIGS. 13 and 14. The body 100*a* includes an opening 101*a* providing a path for the photoreceptor cartridge 200*a* and the development cartridge 300*a* to be mounted or removed. A cover 400*a* opens or closes the opening 101*a*. The exposure unit 110, the transfer roller 120, and the fusing unit 130 are included in the body 100*a*. A recording medium transfer structure for loading and transferring the recording media P on which an image is to be formed is included in the body 100*a*.

The electrophotographic image forming apparatus according to an exemplary embodiment is different from that illustrated in FIGS. 1 through 12 in that toner containing capacity is smaller in the development cartridge 300*a* than the development cartridge 300. The development cartridge 300*a* maybe identical to the development cartridge 300 except in its size and shape. Since the toner containing capacity of the development cartridge 300*a* is smaller than that of the development cartridge 300, the development cartridge 300*a* includes one agitator 7. Hereinafter, components having the same functions as those described above with reference to FIGS. 1 through 12 are denoted by the same reference numerals, and overlapping descriptions are not repeated.

Figure 15:
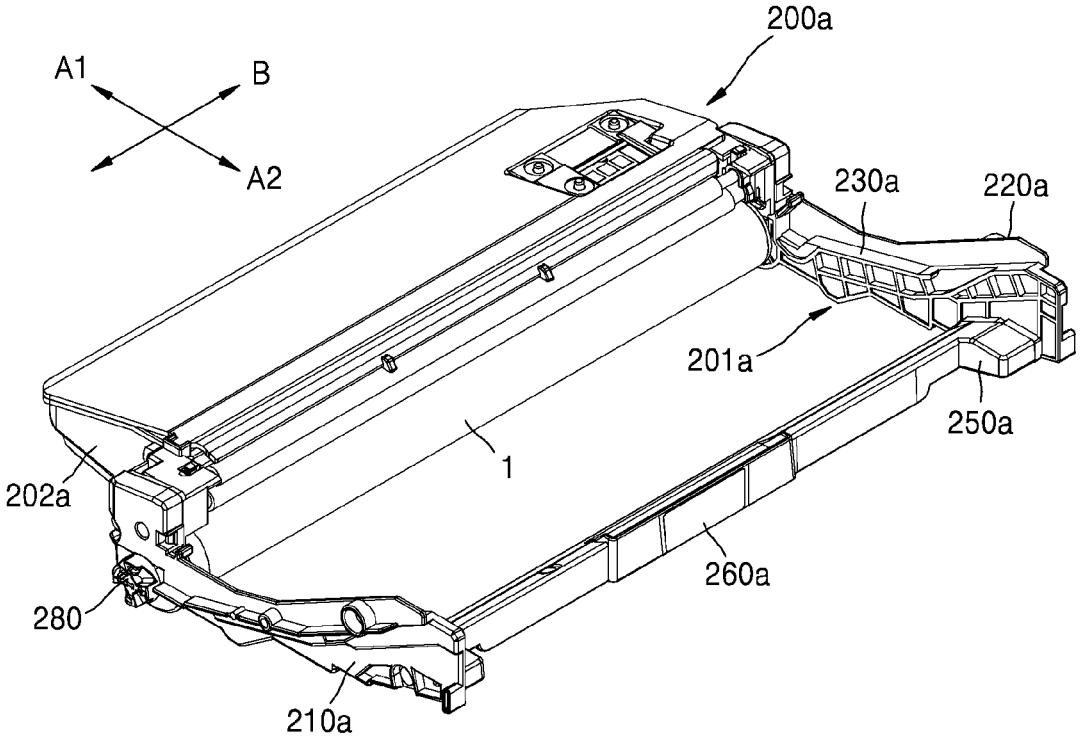
FIG. 15 illustrates a photoreceptor cartridge according to an embodiment of the present invention.

The photoreceptor cartridge 200*a* is mounted in the body 100*a*, and the development cartridge 300*a* is mounted in a mounting portion 201*a* illustrated in FIG. 15 included in the photoreceptor cartridge 200*a*. During a removing process, the development cartridge 300*a* is removed from the mounting portion 201*a*, and the photoreceptor cartridge 200*a* is removed from the body 100*a*.

Figure 16A:
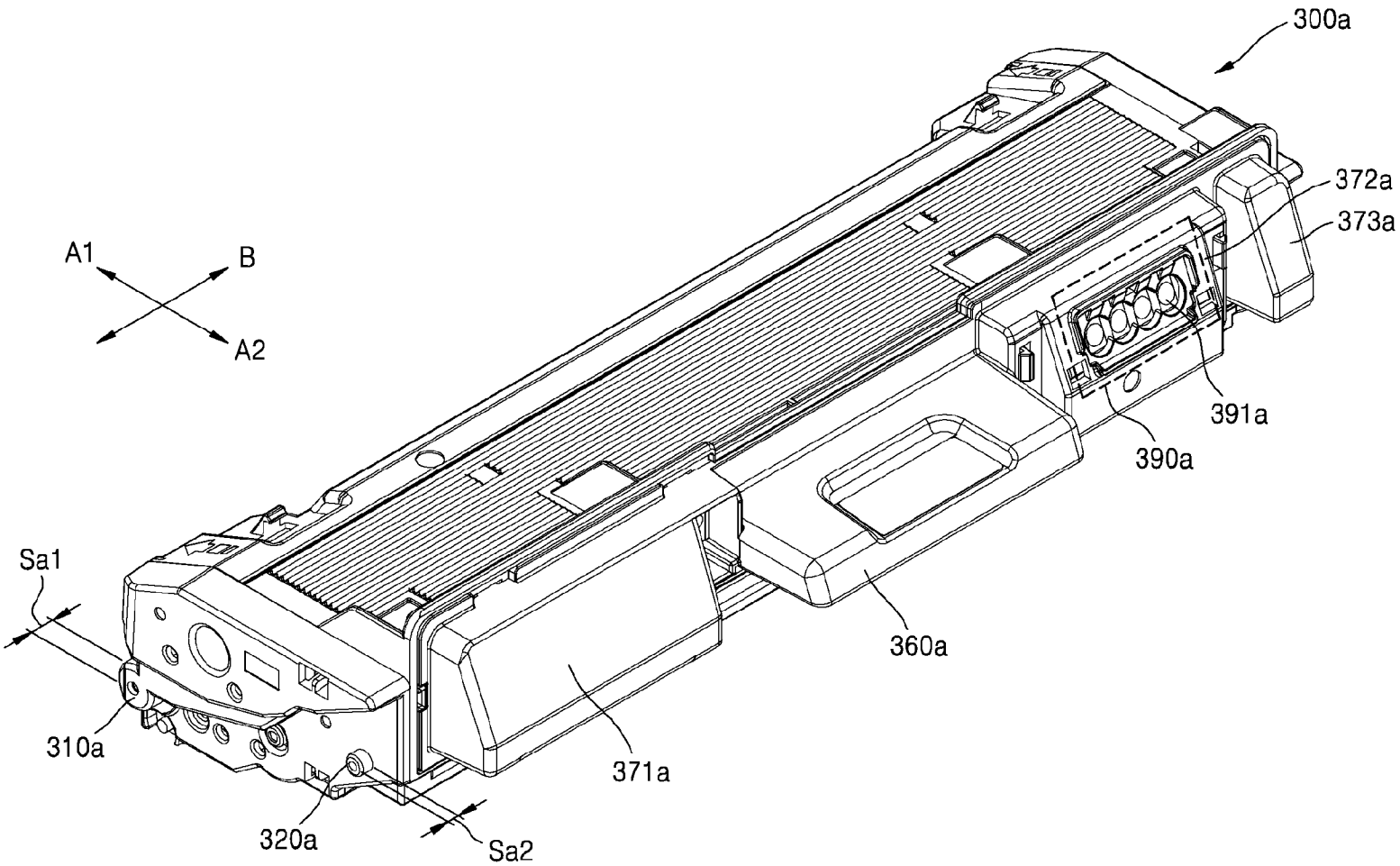
FIGS. 16A and 16B illustrates a development cartridge according to an embodiment of the present invention.
Figure 16B:
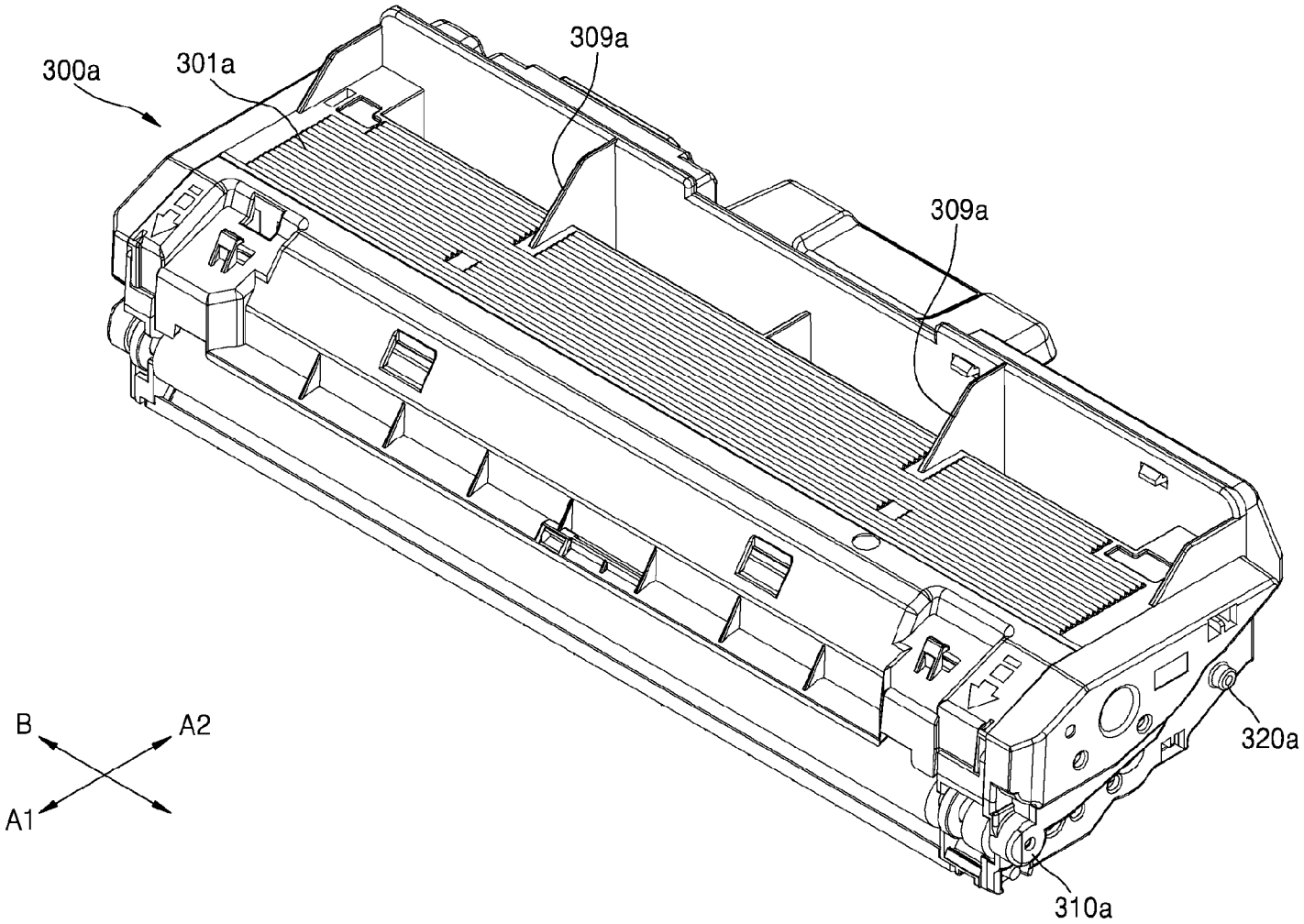

FIG. 15 illustrates the photoreceptor cartridge 200*a* according to an embodiment of the present invention. FIGS. 16A and 16B are perspective views of the development cartridge 300*a* according to an embodiment of the present invention. Referring to FIGS. 15, 16A, and 16B, the photoreceptor cartridge 200*a* includes the mounting portion 201*a* where the development cartridge 300*a* is mounted. The mounting portion 201*a* may include first and second guide members 210*a* and 220*a* extending backwards from both side portions of a frame 202*a* of the photoreceptor cartridge 200*a*. The first and second guide members 210*a* and 220*a* may be connected to each other by a connecting member 250*a* extending in the length direction B of the photoconductive drum 1. The connecting member 250*a* may be connected to rear ends of the first and second guide members 210*a* and 220*a*. Guide rails 230*a*, illustrated, for example, in FIG. 17, may be included in the first and second guide members 210*a* and 220*a*. First and second guide protrusions 310*a* and 320*a* may be at both side portions of the development cartridge 300*a*. The second guide protrusion 320*a* is disposed at a location spaced apart from the first guide protrusion 310*a* backwards. The development cartridge 300*a* is mounted in, or removed from, the mounting portion 201*a* as the first and second guide protrusions 310*a* and 320*a* are supported by the guide rail 230*a*.

The first guide protrusion 310*a* may operate as a location determining protrusion for determining a location of the development roller 4 with respect to the photoconductive drum 1 when the development cartridge 300*a* is mounted in the mounting portion 201*a* of the photoreceptor cartridge 200*a*. For example, the first guide protrusion 310*a* may prevent the development cartridge 300*a* from being pushed backward by being supported by a retreat preventing portion 243*a* of FIG. 24 disposed at a rear portion of the first guide protrusion 310*a*. The first guide protrusion 310*a* may be coaxial with the rotation shaft 41 of the development roller 4. Accordingly, since the location of the development roller 4 may be directly constrained, a location deviation of the development roller 4 due to manufacture tolerance or error may be reduced.

The second guide protrusion 320*a* may operate as a rotation preventing protrusion for preventing the development cartridge 300*a* from rotating when the photoreceptor cartridge 200*a* and the development cartridge 300*a* are driven during an image forming process. For example, the second guide protrusion 320*a* may prevent the development cartridge 300*a* from being rotated as a downstream thereof in a rotation direction of the development roller 4 is supported by a rotation preventing portion 244*a* of FIG. 24. In order to reduce rotation force of the development cartridge 300*a*, the first and second guide protrusions 310*a* and 320*a* may be guided by different rails. Accordingly, at least one of protrusion amounts and sizes (diameters) of the first and second guide protrusions 310*a* and 320*a* may be different. Exemplary embodiments of the first and second guide protrusions 310*a* and 320*a* and the guide rails 230*a* are disclosed.

Figure 17:
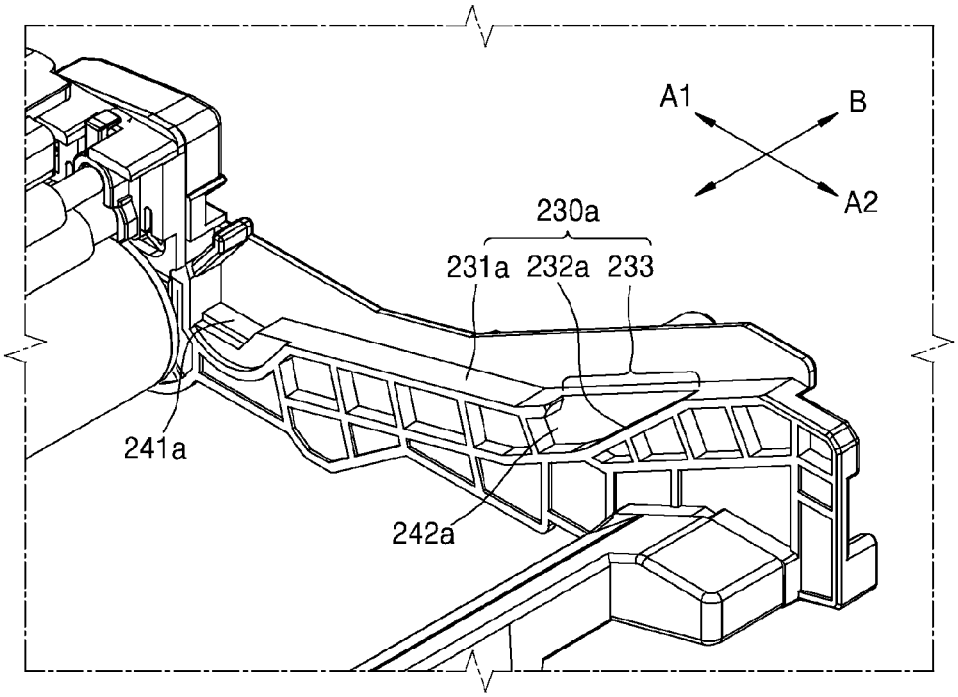
FIG. 17 illustrates a guide rail in detail, according to an embodiment of the present invention.

FIG. 17 illustrates a guide rail 230*a* in detail, according to an embodiment of the present invention. Referring to FIG. 17, the guide rail 230*a* guides the first and second guide protrusions 310*a* and 320*a* respectively to first and second accommodation portions 241*a* and 242*a*. The guide rail 230*a* may have a rib shape protruding inward form an inner wall of each of the first and second guide members 210*a* and 220*a*. The guide rail 230*a* may include a first guide rail 231*a* guiding the first guide protrusion 310*a* to the first accommodation portion 241*a* and a second guide rail 232*a* guiding the second guide protrusion 320*a* to the second accommodation portion 242*a*. In order for the first and second guide protrusions 310*a* and

320*a* to be guided by the first and second guide rails 231*a* and 232*a*, protrusion amounts of the first and second guide protrusions 310*a* and 320 from both side walls of the development cartridge 300*a* are different from each other. For example, the first and second guide protrusions 310*a* and 320*a* may each have a boss shape protruding outward from the both side portions of the development cartridge 300*a* in the length direction B, and referring to FIG. 16*a*, a protrusion amount Sa2 of the second guide protrusion 320*a* is smaller than a protrusion amount Sa1 of the first guide protrusion 310*a*. The second guide rail 232*a* is branched from the first guide rail 231*a* and extends towards the second accommodation portion 242*a*. As illustrated in FIG. 17, the first guide rail 231*a* may be stepped from the second guide rail 232*a* so that the second guide protrusion 320*a* is spaced apart from the first guide rail 231*a* near a branching location 233 where the second guide rail 232*a* is branched from the first guide rail 231*a*. For example, a protrusion amount of the first guide rail 231*a* from the inner wall of the first and second guide members 210*a* and 220*a* near the branching location 233 is smaller than that of the second guide rail 232*a*. Accordingly, the first guide protrusion 310*a* may be continuously guided by the first guide rail 231*a* by passing through the branching location 233, whereas the second guide protrusion 320*a* deviates from the first guide rail 231 and is guided by the second guide rail 232*a* while passing through the branching location 233. The first accommodation portion 241*a* may have a shape, for example, a U- or V-shape, such that the first guide protrusion 310*a* having a cylindrical shape may be inserted and accommodated therein. The second accommodation portion 242*a* may have a shape, for example, a lying U- or V-shape, such that the second guide protrusion 320*a* having a cylindrical shape is inserted and accommodated therein and does not leave from the second accommodation portion 242*a* upwardly. However, the shapes of the first and second accommodation portions 241*a* and 242*a* are not limited thereto.

Referring to FIG. 16B, a third guide protrusion 309*a* may be included in the development cartridge 300*a*. For example, the third guide protrusion 309*a* may have a rib shape protruding upward from a top surface of a housing 301*a* of the development cartridge 300*a*. A region of the third guide protrusion 309*a* contacting an entry guide 190*a* of FIG. 18A included in the body 100*a* may be tilted with respect to the mounting direction A1 so that the development cartridge 300*a* is guided downward by the entry guide 190*a* as the development cartridge 300*a* is inserted into the mounting portion 201*a*. A plurality of the third guide protrusions 309*a* spaced apart from each other in the length direction B may be included in the development cartridge 300*a*. When the development cartridge 300*a* is mounted in the mounting portion 201*a* of the photoreceptor cartridge 200*a* while the photoreceptor cartridge 200*a* is mounted in the body 100*a*, the third guide protrusion 309*a* is guided by the entry guide 190*a* included in the body 100*a*. Accordingly, the development cartridge 300*a* is guided to the mounting portion 201*a*, and the second guide protrusion 320*a* may be guided by the first and second guide rails 231*a* and 232*a*. The entry guide 190*a* may have, for example, a rib shape protruding downward from an upper cover 109*a* of FIG. 13 forming an upper external cover of the body 100*a*.

Figure 18A:
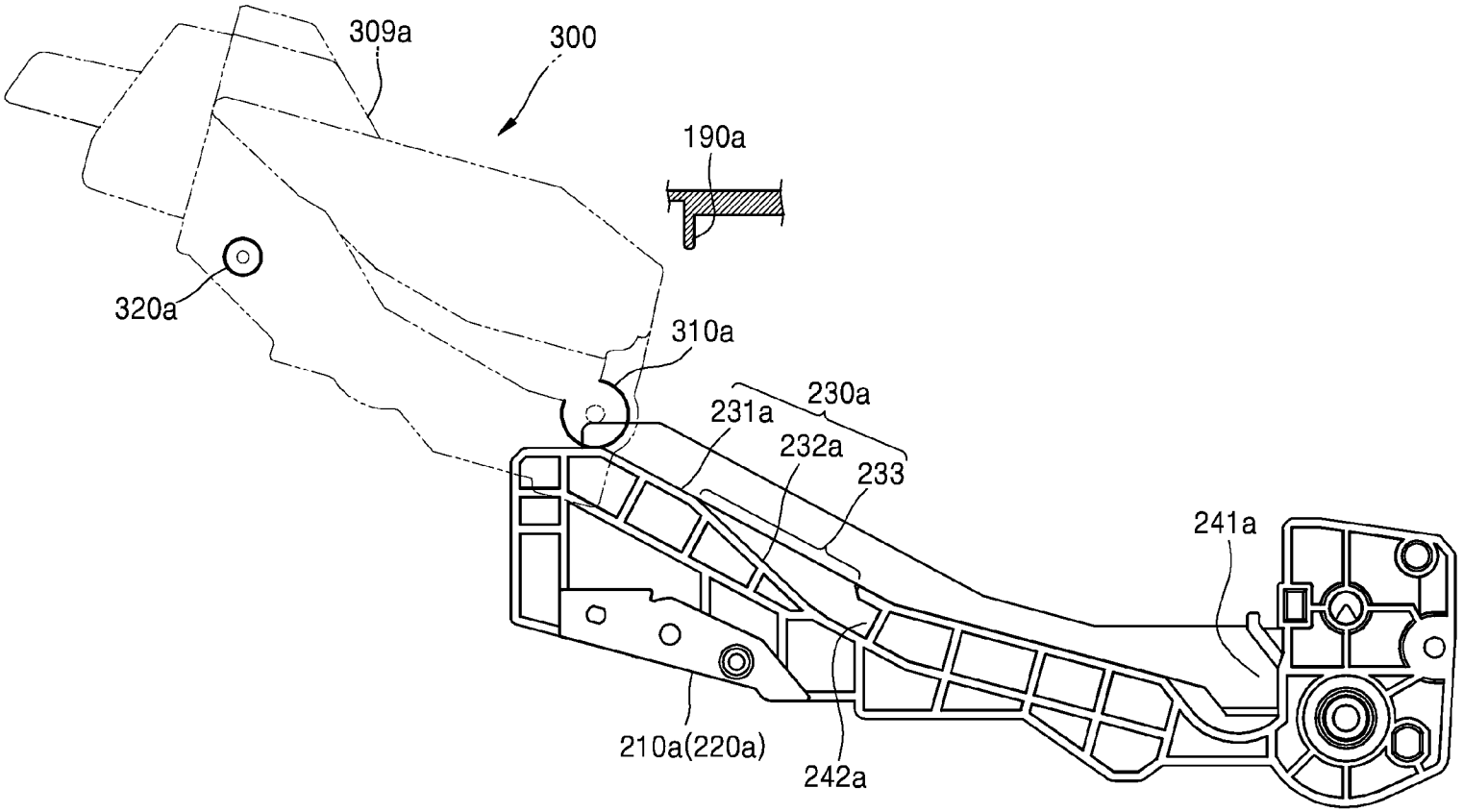
FIGS. 18A through 18C are schematic views for describing a process of amounting a development cartridge in a mounting portion after a photoreceptor cartridge is mounted in a body, according to an embodiment of the present invention.
Figure 18B:
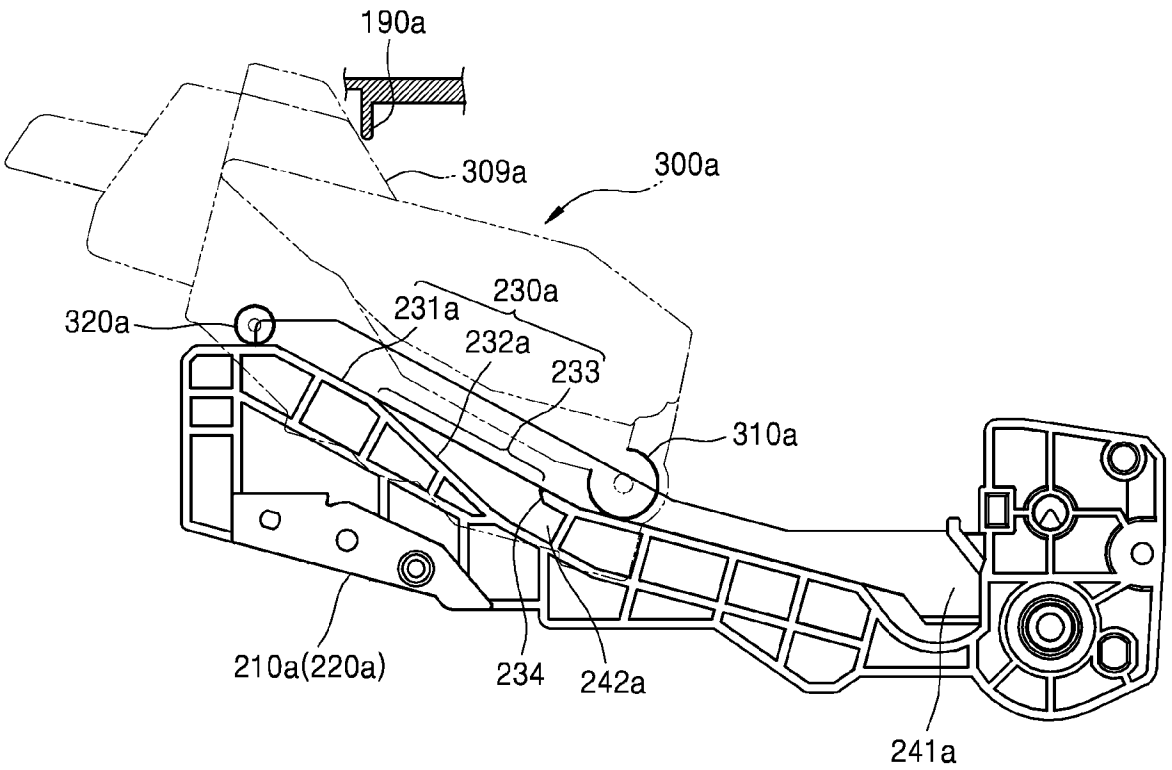
Figure 18C:
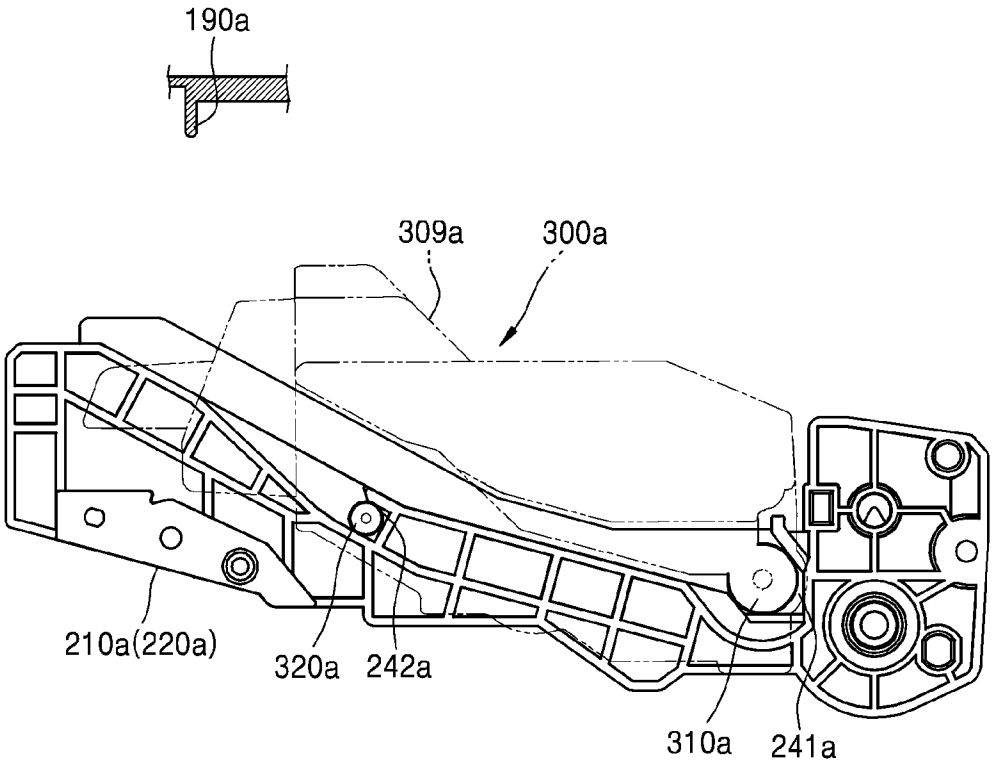

FIGS. 18A through 18C illustrate a process of mounting the development cartridge 300*a* in the mounting portion 201*a* after the photoreceptor cartridge 200*a* is mounted in the body 100*a*, according to an embodiment of the present invention. While the photoreceptor cartridge 200*a* is mounted in the body 100*a*, the development cartridge 300*a* is drawn near the body 100*a* as illustrated in FIG. 18A so that the first guide protrusion 310*a* is supported by the first guide rail 231*a*. Then, the development cartridge 300*a* is pushed into the body 100*a*. As the development cartridge 300*a* is inserted into the body 100*a*, the third guide protrusion 309*a* contacts the entry guide 190*a*, and the second guide protrusion 320*a* is supported by the first guide rail 231*a* as illustrated in FIG. 18B. When the development cartridge 300*a* is continuously inserted, the first guide protrusion 310*a* reaches the branching location 233. Since the protrusion amount of the first guide protrusion 310*a* is larger than that of the second guide protrusion 320*a*, the first guide protrusion 310*a* is continuously guided by the first guide rail 231*a*, and approaches the first accommodation portion 241*a* over the branching location 233. When the second guide protrusion 320*a* reaches the branching location 233, since the protrusion amount of the second guide protrusion 320*a* is smaller than that of the first guide protrusion 310*a* and the first guide rail 231*a* is stepped at the branching location 233, the second guide protrusion 320*a* is separated from the first guide rail 231*a* and is guided by the second guide rail 232*a*. In order for the second guide protrusion 320*a* to enter the second guide rail 232*a* at the branching location 233, a guide portion 234 for guiding the second guide protrusion 320*a* to the second guide rail 232*a* may be included at an end portion of the branching location 233. The guide portion 234 may be a tilting portion tilting downward at an edge corresponding to the end portion of the branching location 233 of the first guide rail 231. When the development cartridge 300*a* is inserted into the body 100*a*, the first and second guide protrusions 310*a* and 320*a* are respectively guided by the first and second guide rails 231*a* and 232*a*, and are accommodated in the first and second accommodation portions 241*a* and 242*a* as illustrated in FIG. 18C.

Referring to FIG. 15, a first handle 260*a* for the user to hold while mounting or removing the photoreceptor cartridge 200*a* in, or from, the body 100*a* may be included in the photoreceptor cartridge 200*a*. The first handle 260*a* may be located at the opening 101*a*, i.e., at the rear of the photoreceptor cartridge 200*a*, so as to be easily found by the user when the cover 400*a* is opened. For example, the first handle 260*a* may be included at a center of the connecting member 250*a* connecting the first and second guide members 210*a* and 220*a*.

Referring to FIG. 16A, a second handle 360*a* for the user to hold while mounting or removing the development cartridge 300*a* in, or from, the body 100*a* may be included in the development cartridge 300*a*. The second handle 360*a* may be located at the opening 101*a*, i.e., at the rear of the development cartridge 300*a* so as to be easily located by the user when the cover 400*a* is opened. The second handle 360*a* may be located above the first handle 260*a* and protrude further backward than the first handle 260*a*. The second handle 360*a* may be included at a rear center of the development cartridge 300*a*.

Driving members such as the photoconductive drum 1 and the charging roller 2 provided in the photoreceptor cartridge 200*a*, and the development roller 4, the supply roller 6, and the agitator 7 provided in the development cartridge 300*a* may be rotated by receiving driving power from a driving unit (not shown) included in the body 100*a*, when the photoreceptor cartridge 200*a* and the development cartridge 300*a* are mounted in the body 100*a*.

According to an electrophotographic image forming apparatus of an exemplary embodiment, the driving power of the driving unit included in the body 100*a* may be transferred to the photoreceptor cartridge 200*a* and the development cartridge 300*a* along a path of the body 100*a*, the photoreceptor cartridge 200*a*, and the development cartridge 300*a*.

Referring to FIGS. 14 and 15, the photoreceptor cartridge 200*a* may be mounted in the body 100*a* by being guided by a mounting rail 108 included in the body 100*a*. The first coupler 160 may be included in the body 100*a*. The first coupler 160 may be included in one or both side portions of the body 100*a*. In an exemplary embodiment, the first coupler 160 is included in one side portion of the body 100*a*. The first coupler 160 may be driven by a driving motor (not shown) in the body 100*a*. The second coupler 280 may be included in one side portion of the photoreceptor cartridge 200*a*. The second coupler 280 may included at the rotation shaft 11 of the photoconductive drum 1 so that rotation power of the second coupler 280 is directly transferred to the photoconductive drum 1. However, an exemplary embodiment of the present invention is not limited thereto, and the second coupler 280 may be connected to the photoconductive drum 1 by a gear train (not shown) in the photoreceptor cartridge 200*a*. When the photoreceptor cartridge 200*a* is mounted in the body 100*a*, the first and second couplers 160 and 280 are engaged with each other, and thus the driving power may be transferred from the body 100*a* to the photoreceptor cartridge 200*a*. Although not illustrated, the charging roller 2 may be connected to the second coupler 280 directly or according to gear connection with the first gear 12 included in the rotation shaft 11 of the photoconductive drum 1.

Figure 19:
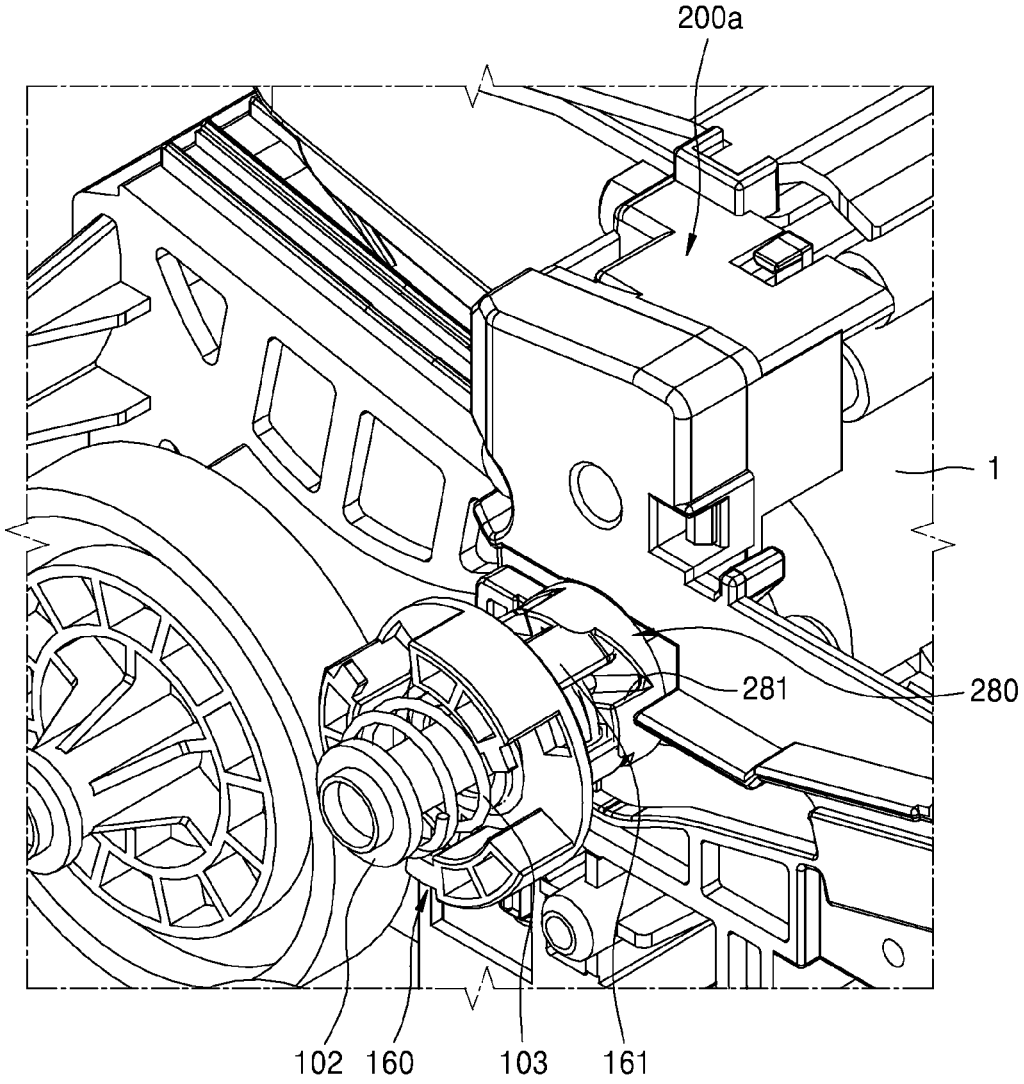
FIG. 19 illustrates first and second couplers, according to an embodiment of the present invention.

FIG. 19 illustrates the first and second couplers 160 and 280, according to an embodiment of the present invention. Referring to FIG. 19, first and second combining portions 161 and 281 may have complementary shapes and may be respectively formed at the first and second couplers 160 and 280. For example, the first combining portion 161 may have a protruding shape and the second combining portion 281 may have a concave shape to be engaged with a plurality of protrusions. The shapes of the first and second combining portions 161 and 281 are not limited as long as the first and second combining portions 161 and 281 are engaged to transfer rotation movement of the first coupler 160 to the second coupler 280, and are not limited by those illustrated in FIG. 19.

The first coupler 160 may be supported by the shaft 102 included in the body 100*a* so as to move in the axial direction. The spring 103 applies elastic force to the first coupler 160 in the direction where the first and second combining portions 161 and 281 are combined. The structures of the first and second couplers 160 and 280 are not limited to those illustrated in FIG. 19. Any one of various power connecting structure, such as gear-gear engaging structure may be employed as the first and second couplers 160 and 280.

Figure 20:
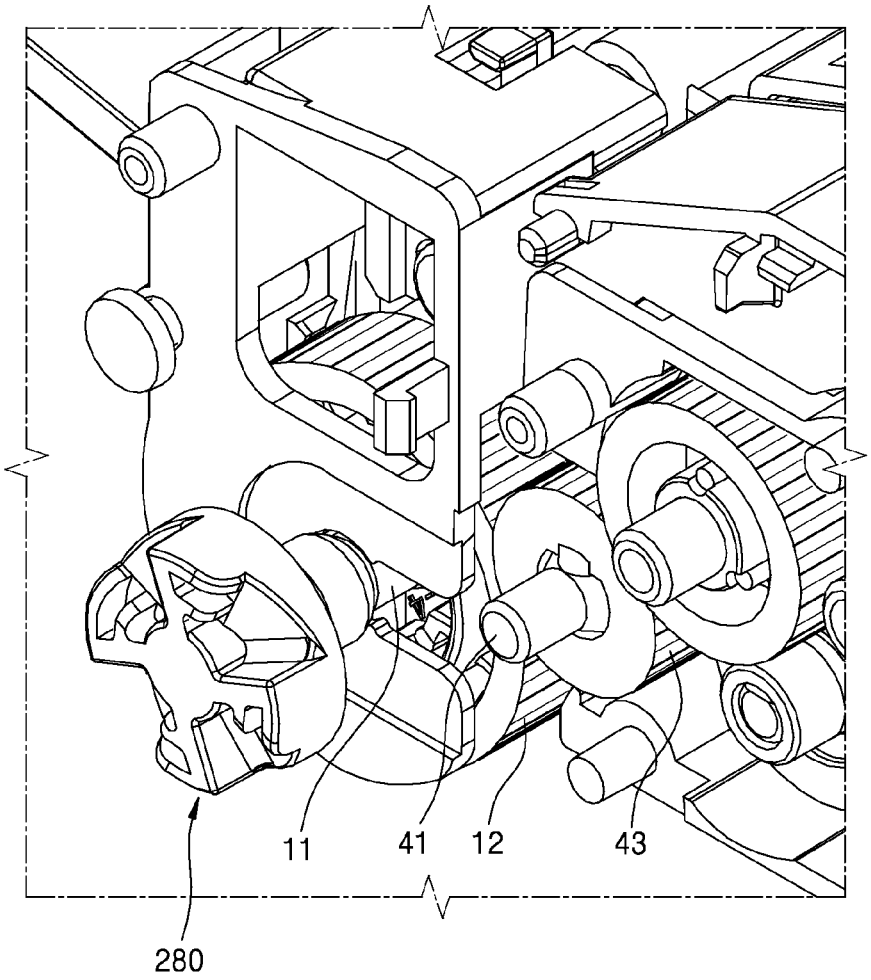
FIG. 20 illustrates a power connecting structure of a photoreceptor cartridge and a development cartridge, according to an embodiment of the present invention.

FIG. 20 illustrates a power connecting structure of the photoreceptor cartridge 200*a* and the development cartridge 300*a*, according to an embodiment of the present invention. Referring to FIG. 20, the second coupler 280 may be included at the rotation shaft 11 of the photoconductive drum 1. The first gear 12 is included at the rotation shaft 11 of the photoconductive drum 1. The second gear 43 is included at the rotation shaft 41 of the development roller 4. When the development cartridge 300*a* is mounted in the photoreceptor cartridge 200*a*, the first and second gears 12 and 43 engage with each other. The supply roller 6 and the agitator 7 may be driven via gear connection with the second gear 43. Accordingly, driving power may be transferred from the photoreceptor cartridge 200*a* to the development cartridge 300*a*.

Even when the development cartridge 300*a* is mounted in the mounting portion 201*a* of the photoreceptor cartridge 200*a* after the photoreceptor cartridge 200*a* is mounted in the body 100*a*, the development cartridge 300*a* is not fixedly combined to the photoreceptor cartridge 200*a*. In other words, the user may remove the photoreceptor cartridge 200*a* and the body 100*a* by simply pulling the development cartridge 300*a* in the removal direction, without having to perform an operation of releasing a combination (unlocking) of the development cartridge 300*a* from the photoreceptor cartridge 200*a*. According to the electrophotographic image forming apparatus of an exemplary embodiment, by pressurizing the development cartridge 300*a* in the mounting direction by closing the cover 400*a*, the development cartridge 300*a* may be fixed to the photoreceptor cartridge 200*a*.

Figure 21:
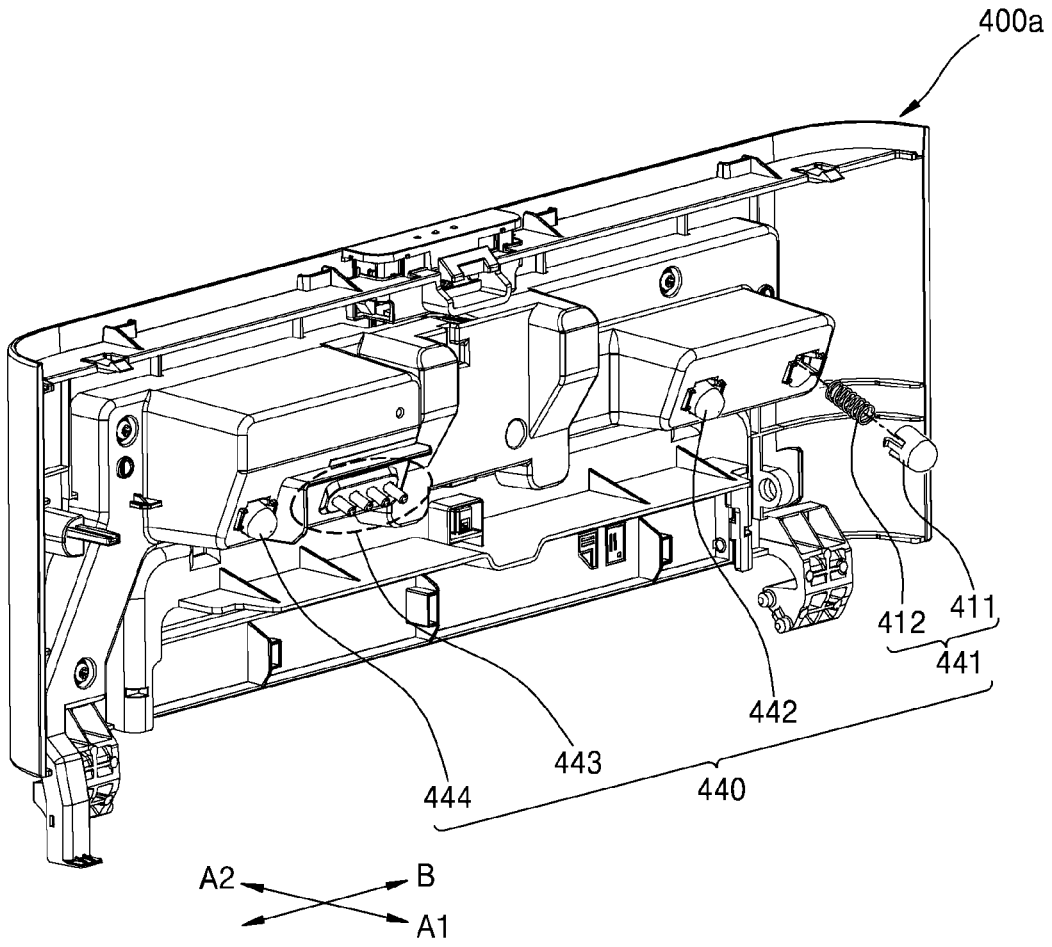
FIG. 21 illustrates a cover according to an embodiment of the present invention.
Figure 22:
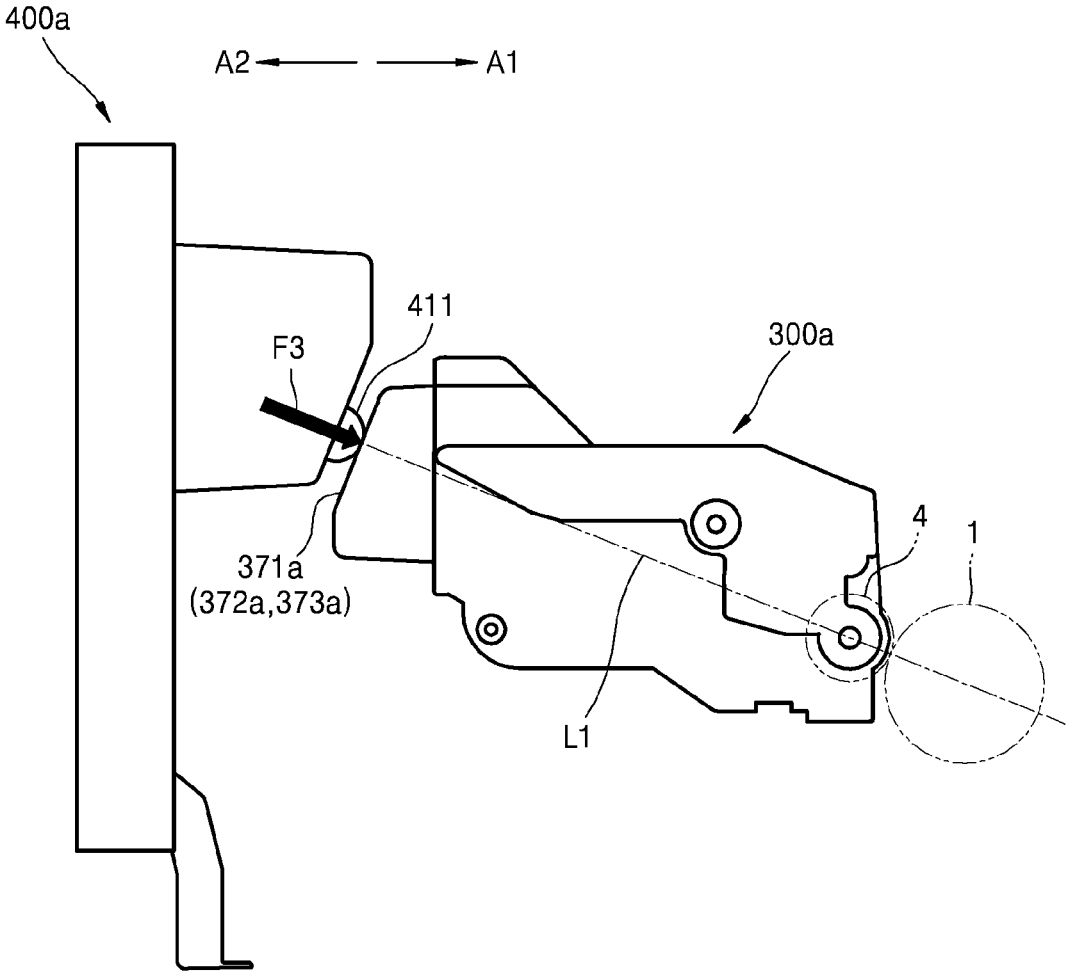
FIG. 22 is a side view showing a state of a development cartridge being pressurized by a pressurization portion while a cover is closed, according to an embodiment of the present invention.

FIG. 21 illustrates a cover 400*a* according to an embodiment of the present invention. FIG. 22 illustrates a state of a development cartridge 300*a* being pressurized by a pressurizing unit 440 while the cover 400*a* is closed, according to an embodiment of the present invention. Referring to FIG. 21, the pressurizing unit 440 may be included in the cover 400*a*. The pressurizing unit 440 may include a plurality of pressurization portions 441, 442, 443, and 444 for pressurizing the development cartridge 300*a* by being disposed in the length direction B. Each of the pressurization portions 441 through 444 may include, for example, a pressurization member 411*a* for pressurizing the development cartridge 300*a*, and an elastic member 412*a* for providing elastic force to the pressurization member 411*a* in a direction pushing the development cartridge 300*a* in the mounting direction A1. The elastic member 412*a* may be a compressive coil spring. Referring to FIGS. 16A and 22, pressure-receiving portions 371*a*, 372*a*, and 373*a* contacting the pressurization member 411*a* may be included at the rear portion of the development cartridge 300*a*. At least one pressure-receiving portion may be disposed on each side of the second handle 360*a* in the length direction B of the photoconductive drum 1. The pressure-receiving portion 371*a* corresponds to the pressurization portions 441 and 442, and the pressure-receiving portions 372*a* and 373*a* respectively correspond to the pressurization portions 443 and 444. When the cover 400*a* is closed as illustrated in FIG. 22 after the development cartridge 300*a* is mounted in the mounting portion 201*a* of the photoreceptor cartridge 200*a* mounted in the body 100*a*, pressing force in the mounting direction A1 is applied to the development cartridge 300*a* by the pressurizing unit 440. The development cartridge 300*a* may be pulled in the mounting direction A1 by the pressing force, and may be stopped as the gap maintaining member 42*a* or 42*b* contacts the photoconductive drum 1 as illustrated in FIG. 3A or 3B. Since the first and second guide protrusions 310*a* and 320*a* are accommodated in the first and second accommodation portions 241*a* and 242*a* having the U- or V-shape, the first and second guide protrusions 310*a* and 320*a* do not deviate from the first and second accommodation portions 241*a* and 242*a* in a direction crossing the mounting direction (direction of pressing force). Accordingly, the development cartridge 300*a* is fixed to the photoreceptor cartridge 200*a*.

As illustrated in FIG. 22, a direction of pressing force F3 by the pressurizing unit 440 may be parallel to a line L1 connecting the centers of the development roller 4 and photoconductive drum 1. The pressing force F3 may match the line L1 or may be spaced apart from the line L1 so as to compensate for a moment of rotation applied to the development cartridge 300*a* according to rotation of the first and second gears 12 and 43. Considering that force of pulling the development cartridge 300*a* towards the first gear 12 may be applied at the location where the first and second gears 12 and 43 are provided, sizes of pressing forces of the pressurization portions 441 and 442 at the location where the first and second gears 12 and 43 are provided may be smaller than sizes of pressing forces of the pressurization portions 443 and 444.

Figure 23:
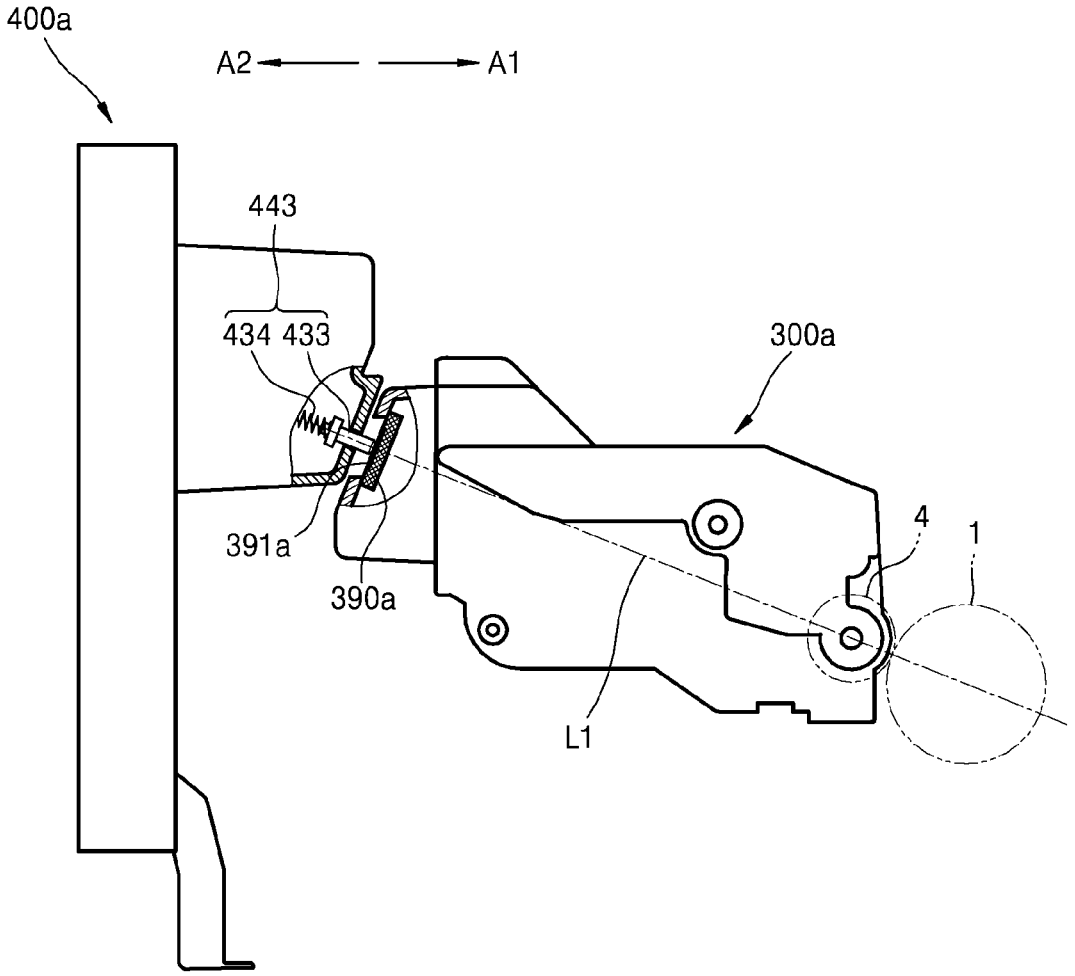
FIG. 23 illustrates an example of a state of a pressurization portion performing a communication function with a memory unit, according to an embodiment of the present invention.

Referring to FIG. 16A, the development cartridge 300*a* may include a memory unit 390*a* that transfers information about the development cartridge 300*a* to the body 100*a* by being electrically connected to the body 100 when the development cartridge 300*a* is mounted in the body 100*a*, and a plurality of first contact portions 391*a* for communication between the memory unit 390*a* and the body 100*a*. A plurality of second contact portions electrically connected to the first contact portions 391*a* may be included in the cover 400*a*. For example, the number of each of the first contact portions 391*a* and the second contact portions may be equal to, or greater, than 4. Referring to FIG. 23, the second contact portion may include the elastic member 434 applying elastic force to the connection pin 433 in a direction the connection pine 433 contacts the first contact portion 391. The elastic force applied by the plurality of second contact portions may fix the development cartridge 300*a* to the mounting portion 201*a*.

The first contact portion 391*a* may be included in any one of the pressure-receiving portions 371*a*, 372*a*, and 373*a*, and one of the pressurization portions 441 through 444 corresponding to the first contact portion 391*a* may operate as the second contact portion. A pressing force applied to the development cartridge 300*a* may be larger at the location where the first and second gears 12 and 43 are not disposed than at the location where the first and second gears 12 and 43 are disposed. Accordingly, the first contact portion and the second contact portion may be disposed at a location where a pressing force is large based on the length direction B. According to an exemplary embodiment, the first contact portion 391*a* may be included in the pressure-receiving portion 372*a* disposed at the location where the first and second gears 12 and 43 are not disposed, and the pressurization portion 443, which is illustrated in FIG. 21, operates as the second contact portion. Accordingly, the pressing force contacting the first contact portion 391*a* and the second contact portion may be effectively used as pressing force fixing the development cartridge 300*a* to the mounting portion 201*a*, and may stably pressurize the development cartridge 300*a* by balancing pressing force in the length direction B.

Figure 24:
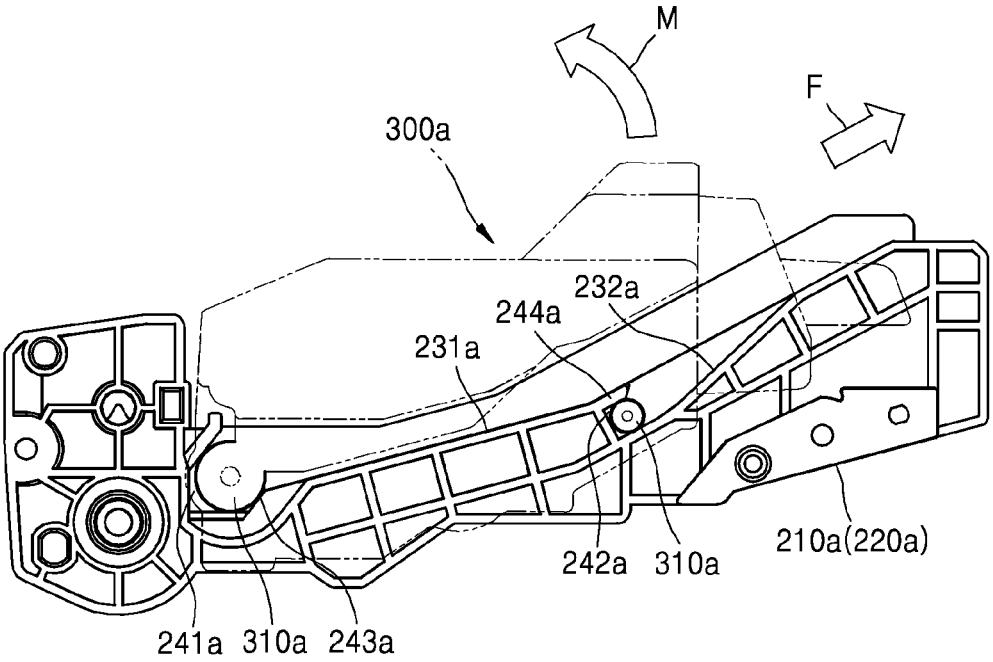
FIG. 24 illustrates a relationship between first and second guide protrusions and first and second accommodation portions while a development cartridge is mounted in a photoreceptor cartridge.

FIG. 24 illustrates an exemplary relationship between the first and second guide protrusions 310*a* and 320*a* and the first and second accommodation portions 241*a* and 242*a* while the development cartridge 300*a* is mounted in the photoreceptor cartridge 200*a*. Referring to FIG. 24, when the development cartridge 300*a* is mounted in the photoreceptor cartridge 200*a*, the first and second guide protrusions 310*a* and 320*a* are respectively disposed in the first and second accommodation portions 241*a* and 242*a*. When the cover 400*a* is closed at this time, the development cartridge 300*a* is pushed in the mounting direction A1 by the pressurizing unit 440 and thus the development roller 4 and the photoconductive drum 1 reach the locations illustrated in FIG. 3A or 3B, and the development cartridge 300*a* no longer moves in the mounting direction A1. The development roller 4 rotates as the second gear 43 provided at the rotation shaft 41 of the development roller 4 and the first gear 12 provided at the rotation shaft 11 of the photoconductive drum 1 are engaged. In the contact development method, a repulsive force F resulting from the compressive deformation of the development roller 4 may be applied to the development cartridge 300*a*. The pushing out (retreating) of the development cartridge 300*a* due to the repulsive power F causes an engage amount of the first and second gears 12 and 43 to be reduced, a contact amount of the development roller 4 and the photoconductive drum 1 to be reduced when the contact development method is used, and the interval between the development roller 4 and the photoconductive drum 1 to be increased when the non-contact development method is used. As a result, an image omission or an image defect caused by faulty rotation of the development roller 4 may be generated. According to an exemplary embodiment, in order to prevent the development cartridge 300*a* from being pushed, the first accommodation portion 241*a* includes a retreat preventing portion 243*a* located at the rear portion of the first guide protrusion 310*a* to support the first guide protrusion 310*a*. The first guide protrusion 310*a* operates as a location determining protrusion for determining a mounting location of the development cartridge 300*a*.

The second guide protrusion 320*a* may be located in the second accommodation portion 242*a*. When the first and second gears 12 and 43 rotate, the moment of rotation M is applied to the development cartridge 300*a*. In order to prevent the development cartridge 300*a* from rotating, the second accommodation portion 242*a* includes a rotation preventing portion 244*a* supporting the second guide protrusion 320*a* by being located at a downstream of the second guide protrusion 320 in the rotation direction of the first gear (or the development roller 4). The second guide protrusion 320*a* operates as a rotation preventing protrusion of the development cartridge 300*a*.

Accordingly, the development cartridge 300*a* may maintain a stable position without being retreated or rotated while the development roller 4 rotates, and a relative location of the photoconductive drum 1 and the development roller 4 may be stably maintained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus comprising:

a body comprising an opening;

a photoreceptor cartridge attached to, or detached from, the body through the opening, and comprising a photoconductive drum and a mounting portion;

a development cartridge attached to, or detached from, the mounting portion through the opening while the photoreceptor cartridge is mounted in the body, and comprising a development roller supplying toner to an electrostatic latent image formed on the photoconductive drum; and a cover for opening or closing the opening, and comprising a pressurizing unit fixing the development cartridge to the mounting portion by providing a pressing force to the development cartridge in a direction parallel to a center line connecting centers of the photoconductive drum and development roller while the opening is closed, wherein the pressurizing unit comprises a first pressurizing unit and a second pressurizing unit respectively providing a first pressing force and a second pressing force to the development cartridge by being spaced apart from the center line in opposite directions respectively by a first distance and a second distance.

2. The electrophotographic image forming apparatus of claim 1, wherein the second pressing force generates a moment in an opposite direction from a moment of rotation generated by rotation of the development roller, and the second pressing force is larger than the first pressing force.

3. The electrophotographic image forming apparatus of claim 1, wherein the second distance is longer than the first distance.

4. The electrophotographic image forming apparatus of claim 1, wherein the first pressurizing unit comprises a plurality of first pressurization portions spaced apart from each other in a length direction of the photoconductive drum, and the second pressurizing unit comprises a plurality of second pressurization portions spaced apart from each other in the length direction of the photoconductive drum.

5. The electrophotographic image forming apparatus of claim 4, wherein the development cartridge comprises a memory unit comprising a first contact portion, wherein the memory unit is electrically connected to the body to transfer information about the development cartridge to the body, and one of the plurality of the first and the second pressurization portions is a second contact portion electrically connected to the first contact portion.

6. The electrophotographic image forming apparatus of claim 5, wherein a first gear and a second gear engaged with each other are respectively provided at one side of a rotation shaft of the photoconductive drum and a rotation shaft of the development roller, and a pressurization portion functioning as the second contact portion from among the plurality of first and second pressurization portions is disposed at a location where the first and second gears are not disposed.

7. An electrophotographic image forming apparatus comprising:

a body comprising an opening;

a photoreceptor cartridge attached to, or detached from, the body through the opening, and comprising a photoconductive drum and a mounting portion;

a development cartridge attached to, or detached from, the mounting portion through the opening while the photoreceptor cartridge is mounted in the body, and comprising a development roller supplying toner to an electrostatic latent image formed on the photoconductive drum; and a cover for opening or closing the opening, and comprising a pressurizing unit fixing the development cartridge to the mounting portion by providing a pressing force to the development cartridge in a direction parallel to a center line connecting centers of the photoconductive drum and development roller while the opening is closed, wherein the pressurizing unit comprises a plurality of pressurization portions spaced apart from each other in a length direction of the photoconductive drum, the development cartridge comprises a plurality of pressure-receiving portions corresponding to the plurality of pressurization portions, wherein the plurality of pressurization portions comprise a plurality of first and second pressurization portions which are disposed opposite to each other based on the center line, and wherein the plurality of pressure-receiving portions comprise a plurality of first and second pressure-receiving portions, which are disposed opposite to each other based on the center line.

8. A development cartridge mounted in a mounting portion provided in a photoreceptor cartridge comprising a photoreceptor, after the photoreceptor cartridge is mounted in a body of an image forming apparatus, and comprising a development roller for developing an image by supplying toner to the photoreceptor, wherein the development cartridge comprises a plurality of pressure-receiving portions receiving a pressing force in a direction parallel to a center line connecting a center of the development roller and the photoreceptor, wherein the development roller is at a front region of the development cartridge based on a mounting direction of the development cartridge mounted in the body, and the plurality of pressure-receiving portions are at a rear region of the development cartridge, further comprising a handle for detaching the development cartridge, wherein the handle is disposed at a rear center of the development cartridge, and wherein at least one of the plurality of pressure-receiving portions is located at each side of the handle.

9. A development cartridge of mounted in a mounting portion provided in a photoreceptor cartridge comprising a photoreceptor, after the photoreceptor cartridge is mounted in a body of an image forming apparatus, and comprising a development roller for developing an image by supplying toner to the photoreceptor, wherein the development cartridge comprises a plurality of pressure-receiving portions receiving a pressing force in a direction parallel to a center line connecting a center of the development roller and the photoreceptor, wherein the plurality of pressure-receiving portions are arranged in a length direction of the photoreceptor, wherein the plurality of pressure-receiving portions comprise a plurality of first pressure-receiving portions and a plurality second pressure-receiving portions disposed opposite to each other based on the center line.

* * * * *

UNITED STATES PATENT AND TRADEMARK OFFICE

CERTIFICATE OF CORRECTION

PATENT NO. : 9,042,773 B2
APPLICATION NO. : 13/906582
DATED : May 26, 2015
INVENTOR(S) : Hyung-seok Chang et al.

It is certified that error appears in the above-identified patent and that said Letters Patent is hereby corrected as shown below:

In the claims

Claim 9, Column 26, Line 32 (Approximately)

After “cartridge” delete “of”.

Claim 9, Column 26, Line 46

Delete “plurality” and insert --plurality of--, therefor.

Signed and Sealed this
Thirteenth Day of October, 2015

Michelle K. Lee

Michelle K. Lee
*Director of the United States Patent and Trademark Office*